US011561501B2

(12) United States Patent
Kobayashi et al.

(10) Patent No.: US 11,561,501 B2
(45) Date of Patent: Jan. 24, 2023

(54) METHOD OF MANUFACTURING METAL FRAME OF IMAGE FORMING APPARATUS

(71) Applicant: CANON KABUSHIKI KAISHA, Tokyo (JP)

(72) Inventors: Takahiro Kobayashi, Chiba (JP); Ryo Yokoi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/398,568

(22) Filed: Aug. 10, 2021

(65) Prior Publication Data

US 2022/0075311 A1 Mar. 10, 2022

(30) Foreign Application Priority Data

Sep. 4, 2020 (JP) ..... JP2020-148983

(51) Int. Cl.
*G03G 21/16* (2006.01)
*G03G 15/00* (2006.01)

(52) U.S. Cl.
CPC ..... *G03G 21/1619* (2013.01); *G03G 15/00* (2013.01); *G03G 2215/0132* (2013.01)

(58) Field of Classification Search
CPC ..... G03G 21/1619; G03G 15/00; G03G 2215/0132
See application file for complete search history.

(56) References Cited

U.S. PATENT DOCUMENTS 9,442,458 B2 9/2016 Kobayashi et al. ..... G03G 21/1647
10,274,893 B2 4/2019 Yasui et al. ..... G03G 21/1619
10,691,061 B2 6/2020 Yasui ..... G03G 21/1647
10,775,733 B2 9/2020 Kobayashi et al. ..... G03G 15/0865
10,990,059 B2 4/2021 Kawasumi et al. ..... G03G 21/1619
11,099,517 B2 8/2021 Nakamura et al. ..... G03G 21/1619
2009/0218472 A1* 9/2009 Takemoto ..... G03G 21/1619 248/542
2016/0195844 A1* 7/2016 Takei ..... G03G 21/1619 228/178

(Continued)

FOREIGN PATENT DOCUMENTS

JP 2008-116619 5/2008

OTHER PUBLICATIONS

U.S. Appl. No. 17/398,743, filed Aug. 10, 2021.
U.S. Appl. No. 17/398,809, filed Aug. 10, 2021.

*Primary Examiner* — Sandra Brase
(74) *Attorney, Agent, or Firm* — Venable LLP

(57) ABSTRACT

A method of manufacturing a metal frame of an image forming apparatus includes assembling a first support, a second support, and a connecting member using a first jig having a base portion, whereafter there is a positioning of a position where the first support, the second support, and the connecting portion are fixed using a second jig having an insertion portion. In the first support, the insertion portion is inserted into a hole portion formed in a second metal plate so that the second metal plate moves upward in the vertical direction with respect to a first metal plate, and a restricting portion formed on one of the first and second metal plates abutted to the other metal plate in the assembly are separated from each other. The first support and the connecting member are fixed to each other, and the second support and the connecting member are fixed to each other.

10 Claims, 32 Drawing Sheets

(56) References Cited

U.S. PATENT DOCUMENTS

| | | | | |
|---|---|---|---|---|
| 2017/0010578 | A1* | 1/2017 | Miyakawa | G03G 21/1619 |
| 2020/0094302 | A1 | 3/2020 | Yahagi et al. | B21D 5/01 |
| 2021/0063943 | A1 | 3/2021 | Tomono et al. | G03G 21/1619 |
| 2021/0063946 | A1 | 3/2021 | Watanabe et al. | G03G 21/1619 |

* cited by examiner

METHOD OF MANUFACTURING METAL FRAME OF IMAGE FORMING APPARATUS

BACKGROUND OF THE INVENTION

Field of the Invention

The present invention relates to a method of manufacturing a metal frame of an image forming apparatus such as an electrophotographic copying machine and an electrophotographic printer (for example, a laser beam printer or a light emitting diode (LED) printer).

Description of the Related Art

A frame of an image forming apparatus is generally formed by fixing a plurality of metal plates such as a front side plate, a rear side plate, and a stay connecting between the front side plate and the rear side plate to each other by welding or the like. By fixing such metal plates to each other in a state where they are assembled to each other with high position accuracy, position accuracy between respective members supported by the frame is maintained, such that it becomes possible to form a high-quality image.

Meanwhile, Japanese Patent Application Laid-Open No. 2008-116619 describes a configuration for assembling a first metal plate and a second metal plate, which are metal plates constituting a frame of an image forming apparatus, to each other with high position accuracy. The configuration described in Japanese Patent Application Laid-Open No. 2008-116619 is a configuration in which a protrusion portion formed on the first metal plate is inserted into an opening portion formed in the second metal plate to assemble the first metal plate and the second metal plate to each other. A first bulging portion that abuts on one surface of the protrusion portion of the first metal plate in a plate thickness direction and a second bulging portion that abuts on the other surface of the first metal plate in the plate thickness direction are formed inside the opening portion of the second metal plate. By nipping the protrusion portion from the thickness direction of the first metal plate by the first bulging portion and the second bulging portion, the position of the first metal plate in the plate thickness direction of the first metal plate is determined with respect to the second metal plate. Further, by making the width of the opening portion and the width of the protrusion portion substantially the same in the direction orthogonal to the thickness direction of the first metal plate and the thickness direction of the second metal plate, the position of the first metal plate in the direction orthogonal to the second metal plate can be determined.

In the configuration described in Japanese Patent Application Laid-Open No. 2008-116619, when the first metal plate and the second metal plate are fixed by welding or the like in the state of being assembled as described above, the position accuracy after fixing the first metal plate or the second metal plate will be affected by the dimensional tolerance when forming the first metal plate or the second metal plate. That is, the position accuracy after fixing the first metal plate or the second metal plate is affected by cutting tolerances and bending tolerances when forming the above-mentioned first bulging portion, the second bulging portion, the protrusion portion, the opening portion, and the like, which are positioned when assembling the first metal plate or the second metal plate.

When the position accuracy when fixing each metal plate constituting the frame of the image forming apparatus is affected by the tolerance when forming each metal plate in this way, since the position accuracy when fixing the metal plates deteriorates, the accuracy of the frame of the image forming apparatus constituted by fixing the metal plates deteriorates. As a result, the position accuracy between the members supported by the frame deteriorates, which may adversely affect the image quality.

SUMMARY OF THE INVENTION

It is desirable to provide a method of manufacturing a metal frame of an image forming apparatus capable of suppressing deterioration of position accuracy when fixing each metal plate constituting a frame.

A representative configuration of the present invention provides a method of manufacturing a metal frame of an image forming apparatus including a first support that includes a first metal plate and a second metal plate disposed above the first metal plate in a vertical direction and supporting one end of an image forming unit, a second support that is disposed at intervals with respect to the first support and supports the other end of the image forming unit together with the first support, and a connecting member that connects the first support and the second support, the method including:

assembling the first support, the second support, and the connecting member using a first jig having a base portion, in the assembling, in the first support, a restricting portion formed on one of the first metal plate and the second metal plate abutting on the other metal plate so as to restrict movement of the second metal plate downward in the vertical direction with respect to the first metal plate;

positioning a position where the first support, the second support, and the connecting portion are fixed using a second jig having an insertion portion, in the positioning, in the first support, the insertion portion being inserted into a hole portion formed in the second metal plate so that the second metal plate moves upward in the vertical direction with respect to the first metal plate, and the restricting portion abutted in the assembling and the other metal plate being separated from each other; and fixing the first support and the connecting member in a state in which the position is determined in the positioning, and fixing the second support and the connecting member in the state where the position is determined in the positioning step are performed, in the fixing step, the first metal plate and the second metal plate being fixed to the first support.

Further features of the present invention will become apparent from the following description of exemplary embodiments with reference to the attached drawings.

DESCRIPTION OF THE EMBODIMENTS

<Image Forming Apparatus>

Hereinafter, an overall configuration of an image forming apparatus according to the present invention will be described with reference to the drawings, together with an operation at the time of image formation. Note that dimensions, materials, shapes, relative arrangements, and the like of components described below are not intended to limit the scope of the present invention unless specifically stated otherwise.

An image forming apparatus A according to the present embodiment is an intermediate tandem type image forming apparatus that transfers toners of four colors of yellow Y, magenta M, cyan C, and black K to an intermediate transfer belt, and then transfers an image to a sheet to form the image. Note that in the following description, Y, M, C, and K are added as subscripts to members using the toners of the respective colors, but since configurations or operations of the respective members are substantially the same as each other except that colors of the toners used in the respective members are different from each other, the subscripts are appropriately omitted unless it is necessary to distinguish the configurations or the operations of the respective members from each other.

Figure 1:
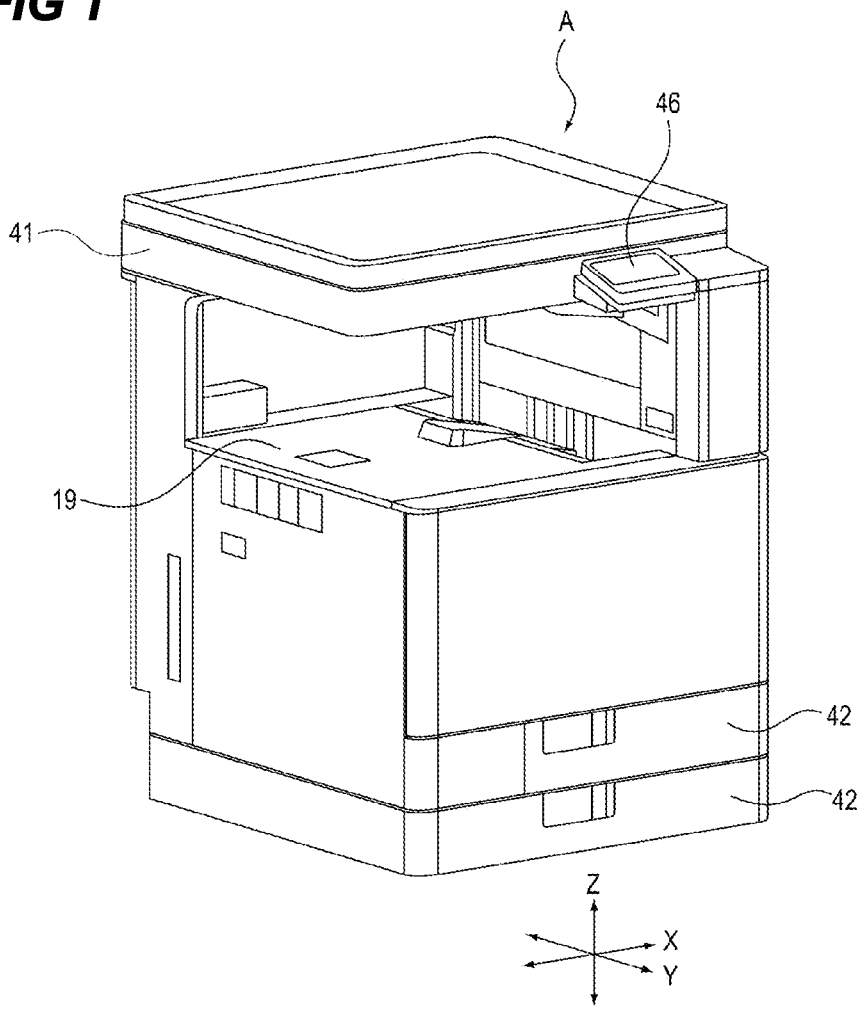
FIG. 1 is a schematic perspective view of an image forming apparatus.
Figure 2:
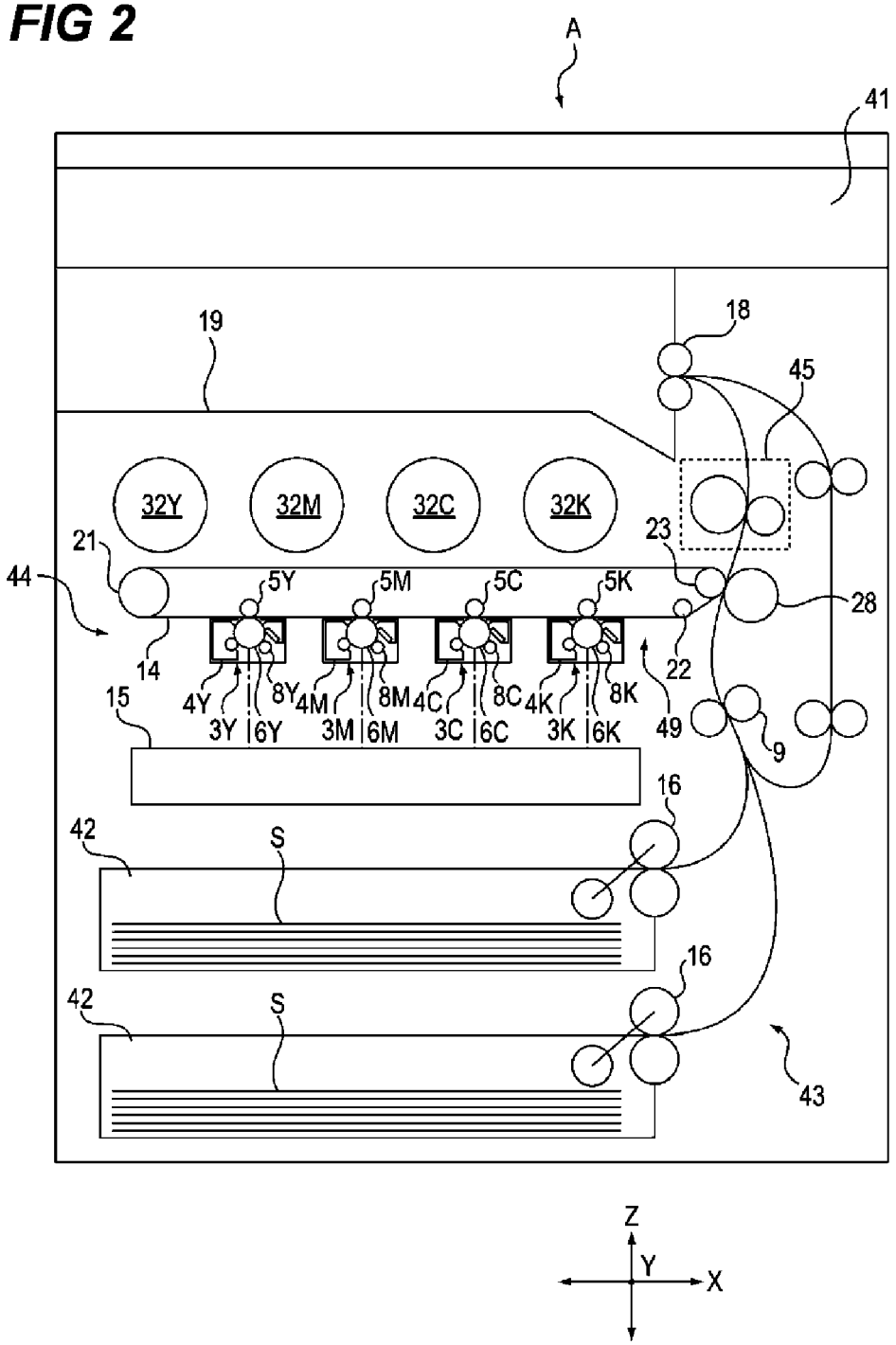
FIG. 2 is a schematic cross-sectional view of the image forming apparatus.

FIG. 1 is a schematic perspective view of an image forming apparatus A. FIG. 2 is a schematic cross-sectional view of an image forming apparatus A. As illustrated in FIGS. 1 and 2, the image forming apparatus A includes an image forming portion 44 that forms a toner image and transfers the toner image to a sheet, a sheet feeding portion 43 that feeds the sheet toward the image forming portion 44, and a fixing portion 45 that fixes the toner image to the sheet. In addition, an image reading portion 41 that reads an image of an original is provided at an upper portion of the image forming apparatus A.

The image forming portion 44 includes a process cartridge 3: 3Y, 3M, 3C, and 3K, a laser scanner unit 15, and an intermediate transfer unit 49. The process cartridge 3, which is an example of the image forming unit, is configured to be detachably attached to the image forming apparatus A, and includes a photosensitive drum 6: 6Y, 6M, 6C, and 6K, a charging roller 8: 8Y, 8M, 8C, and 8K, and a developing device 4: 4Y, 4M, 4C, and 4K.

The intermediate transfer unit 49 includes a primary transfer roller 5: 5Y, 5M, 5C, and 5K, an intermediate transfer belt 14, a secondary transfer roller 28, a secondary transfer counter roller 23, a driving roller 21, and a tension roller 22. The intermediate transfer belt 14 is stretched over the secondary transfer counter roller 23, the driving roller 21, and the tension roller 22, the driving roller 21 rotates by a driving force of a motor (not illustrated), and the intermediate transfer belt 14 circularly moves according to the rotation of the driving roller 21.

Next, an image forming operation by the image forming apparatus A will be described. First, when an image forming job signal is input to a controller (not illustrated), a sheet S stacked and stored in a sheet cassette 42 is sent out to a registration roller 9 by a feeding roller 16. Next, the sheet S is sent into a secondary transfer portion including the secondary transfer roller 28 and the secondary transfer counter roller 23 at a predetermined timing by the registration roller 9.

Meanwhile, in the image forming portion, first, a surface of the photosensitive drum 6Y is charged by the charging roller 8Y. Then, the laser scanner unit 15 irradiates the surface of the photosensitive drum 6Y with laser light according to an image signal transmitted from an external device (not illustrated) or the like to form an electrostatic latent image on the surface of the photosensitive drum 6Y.

Then, a yellow toner is attached to the electrostatic latent image formed on the surface of the photosensitive drum 6Y by the developing device 4Y to form a yellow toner image on the surface of the photosensitive drum 6Y. The toner image formed on the surface of the photosensitive drum 6Y is primarily transferred to the intermediate transfer belt 14 by applying a bias to the primary transfer roller 5Y.

Magenta, cyan, and black toner images are also formed on the photosensitive drums 6M, 6C, and 6K by a similar process. These toner images are transferred in a superimposed manner onto the yellow toner image on the intermediate transfer belt 14 by applying a primary transfer bias to the primary transfer rollers 5M, 5C, and 5K. As a result, a full-color toner image is formed on a surface of the intermediate transfer belt 14.

Note that when the toner inside the developing device 4 is used by the developing process described above, such that an amount of toner inside the developing device 4 decreases, each developing device 4 is replenished with a toner of each color by a toner bottle 32: 32Y, 32M, 32C, and 32K. The toner bottle 32 is configured to be detachably attachable to the image forming apparatus A.

Then, the intermediate transfer belt 14 circularly moves, such that a full-color toner image is sent to the secondary transfer portion. The full-color toner image on the intermediate transfer belt 14 is transferred to the sheet S by applying a bias to the secondary transfer roller 28 in the secondary transfer portion.

Then, the sheet S to which the toner image is transferred is subjected to heating and pressuring processing in the fixing portion 45, such that the toner image on the sheet S is fixed to the sheet S. Then, the sheet S to which the toner image is fixed is discharged to a discharge portion 19 by a discharge roller 18.

<Frame of Image Forming Apparatus>

Next, a frame 31 (metal frame) of the image forming apparatus A will be described.

Figure 3:
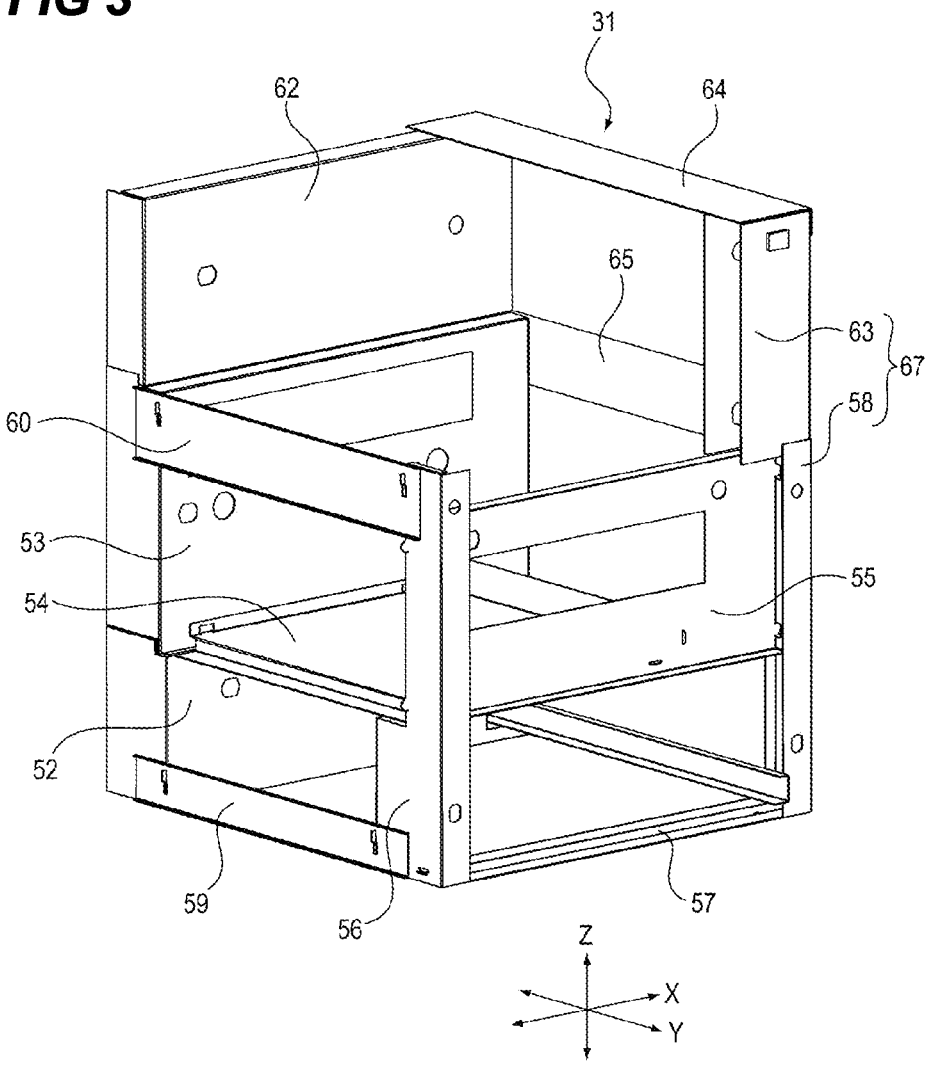
FIG. 3 is a perspective view of a frame of the image forming apparatus.
Figure 4:
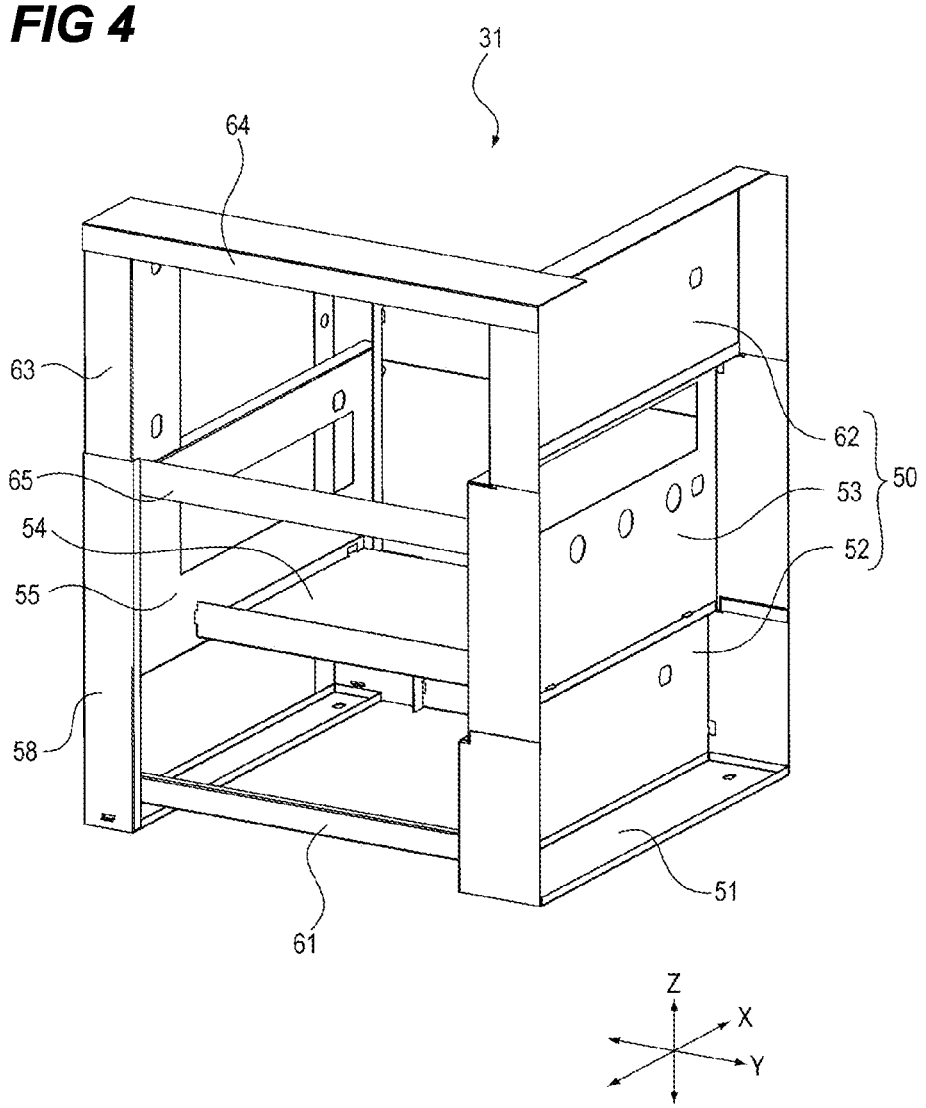
FIG. 4 is a perspective view of the frame of the image forming apparatus.

FIG. 3 is a perspective view of the frame 31 of the image forming apparatus A when viewed from a front surface side of the image forming apparatus A, and is a perspective view of a state where an internal unit such as an image forming unit or an exterior cover is removed. FIG. 4 is a perspective view of the frame 31 of the image forming apparatus A when viewed from a rear surface side of the image forming apparatus A. Note that an arrow X direction illustrated in the drawings is a horizontal direction and indicates a left and right direction of the image forming apparatus A. In addition, an arrow Y direction is a horizontal direction and indicates a front and rear direction of the image forming apparatus A. In addition, an arrow Z direction is a vertical direction and indicates an up and down direction of the image forming apparatus A. In addition, a front side of the image forming apparatus A is a side on which a user normally stands in order to operate an operation portion 46 for performing a setting regarding image formation, and a rear side of the image forming apparatus A is a side opposite to the front side across the frame 31. In addition, a left side of the image forming apparatus A is a left side when viewed from the front side, and a right side of the image forming apparatus A is a right side when viewed from the front side. In addition, the front side of the image forming apparatus A is a direction in which the sheet cassette 42 is pulled out from the image forming apparatus A when the sheet cassette 42 is replenished with sheets, and is a direction in which the toner bottle 32 is pulled out when the toner bottle 32 is replaced.

As illustrated in FIGS. 3 and 4, the image forming apparatus A includes a front side plate 55 (second support), a left support column 56, and a right support column 67 that are formed of a metal plate, as the frame 31 on a front surface side thereof. The left support column 56 is connected to an end portion of one side of the front side plate 55 in the arrow X direction. The right support column 67 is connected to an end portion of the other side of the front side plate 55 in the arrow X direction. In addition, the right support column 67 includes a right support column 58 (lower right support column) and a right support column 63 (upper right support column) connected to an upper side of the right support column 58 in the vertical direction. The left support column 56 and the right support column 58 are connected to each other by a front lower stay 57.

In addition, the image forming apparatus A includes a rear side plate 50 (first support) formed of a metal plate, as the frame 31 on a rear surface side thereof. The rear side plate 50 is arranged to face the front side plate 55, and supports the process cartridge 3 or the intermediate transfer unit 49 together with the front side plate 55. The rear side plate 50 is trisected into rear side plates 52, 53, and 62 in the vertical direction, the rear side plate 53 (second metal plate) is connected to an upper portion of the rear side plate 52 (first metal plate) in the vertical direction, and the rear side plate 62 (third metal plate) is connected to an upper portion of the rear side plate 53 in the vertical direction. A thickness of metal plate of each of the rear side plates 52, 53, and 62 is about 0.6 mm to 2 mm. In addition, a rear bottom plate 51 is provided below the rear side plate 52.

In addition, the image forming apparatus A includes a left lower stay 59, a left upper stay 60, a right lower stay 61, a right middle stay 65, a right upper stay 64, and a middle stay 54, as the frame 31 connecting the frame 31 on the front surface side and the frame 31 on the rear surface side to each other. Here, the left lower stay 59, the left upper stay 60, the right lower stay 61, the right middle stay 65, the right upper stay 64, and the middle stay 54 are an example of a connecting member for connecting the rear side plate 50, which is the frame 31 on the rear surface side, and the front side plate 55, the left support column 56, and the right support column 67, which are the frame 31 on the front surface side, to each other. The left lower stay 59 connects the left support column 56 and the rear side plate 52 to each other. The left upper stay 60 connects the left support column 56 and the rear side plate 53 to each other. The right lower stay 61 connects the right support column 58 and the rear side plate 52 to each other. The right middle stay 65 connects the rear side plate 53 and the right support column 58 to each other. The right upper stay 64 connects the right support column 63 and the rear side plate 62 to each other. The middle stay 54 connects the front side plate 55 and the rear side plate 53 to each other.

Note that each of the members constituting the frame 31 described above is formed of one metal plate. These metal plates are processed into a predetermined shape by drawing or the like, temporarily assembled in an assembly process described later, and then fixed through a fixing process to form the frame 31.

<Frame Assembling Process>

Next, a process of assembling a plurality of metal plates constituting the frame 31 will be described. FIGS. 5 to 24 are views illustrating aspects where the metal plates constituting the frame 31 are assembled.

Figure 5:
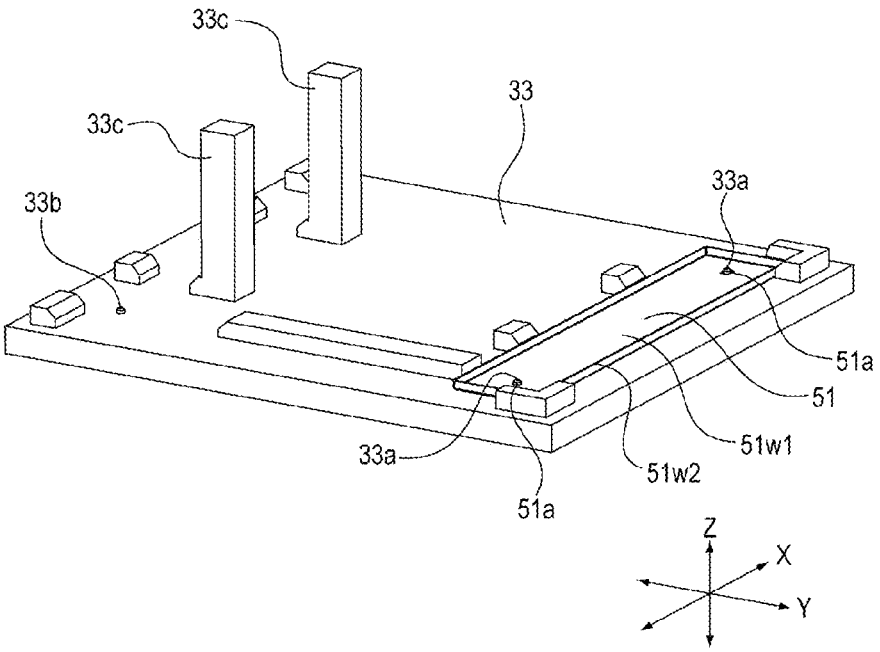
FIG. 5 is a perspective view when a rear bottom plate is assembled.

As illustrated in FIG. 5, a stand 33 as a first jig is used when the metal plates constituting the frame 31 are assembled. The stand 33 has a base portion provided with positioning pins 33*a* and 33*b*, and a support column 33*c* (support portion) erected on the base portion. First, the rear bottom plate 51 is placed on the stand 33. The rear bottom plate 51 includes a flat surface portion 51*w*1 facing the stand 33, and a bent and raised portion 51*w*2 bent and raised from the flat surface portion 51*w*1. The bent and raised portion 51*w*2 is formed at least on a side engaging with the rear side plate 52. When the rear bottom plate 51 is placed on the stand 33, a position of the rear bottom plate 51 with respect to the stand 33 is determined by inserting the positioning pins 33*a* of the stand 33 into positioning holes 51*a* formed in the flat surface portion 51*w*1 of the rear bottom plate 51.

Figure 6A:
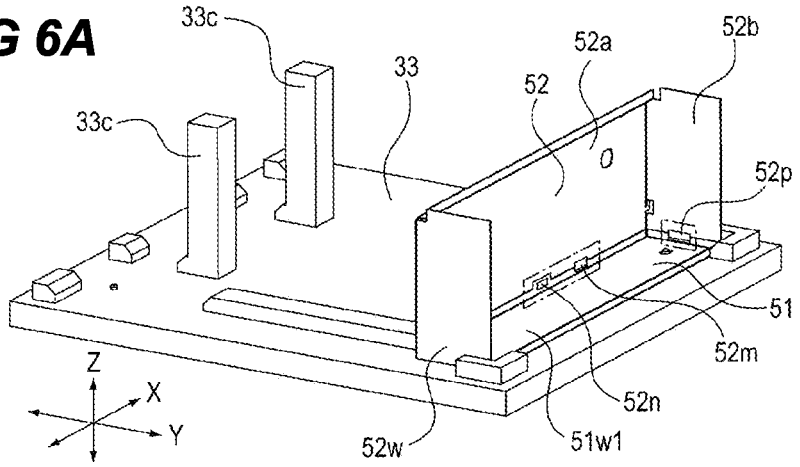
FIGS. 6A to 6C are perspective views when a rear side plate is assembled.
Figure 6B:
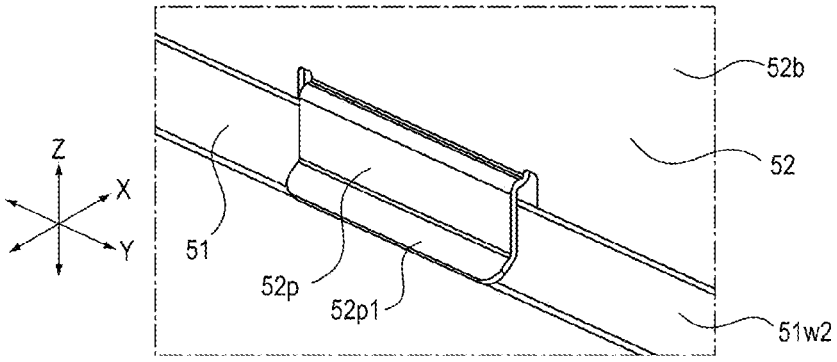
Figure 6C:
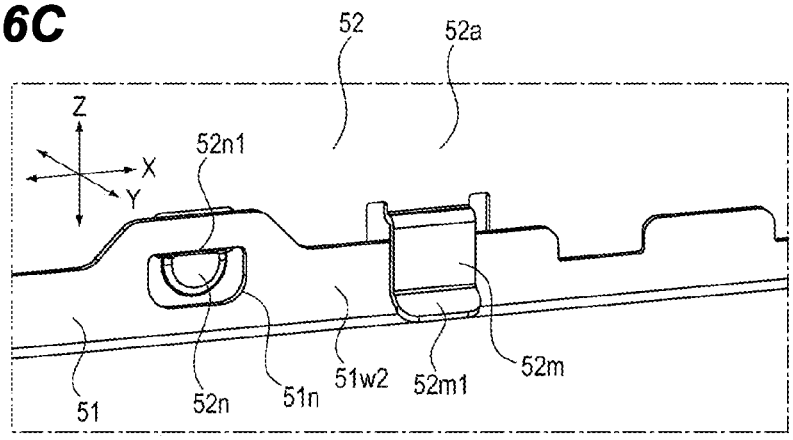

Next, as illustrated in FIGS. 6A to 6C, the rear side plate 52 is assembled. The rear side plate 52 is subjected to bending so as to have a U-shape having three flat surfaces. The rear side plate 52 includes a flat surface portion 52*a* located on a rear surface of the image forming apparatus A, and a bent portion 52*b* bent with respect to the flat surface portion 52*a* and extending rearward of the image forming apparatus A, and a bent portion 52*w* bent with respect to the flat surface portion 52*a* so as to face the bent portion 52*b*. The rear side plate 52 is inserted and assembled into the rear bottom plate 51. A projection portion 52*n* formed so as to protrude by drawing in a plate thickness direction of the flat surface portion 52*a* and a step-bent portion 52*m* are provided at a lower portion of the flat surface portion 52*a* of the rear side plate 52. A step-bent portion 52*p* is provided at a lower portion of the bent portion 52*b* of the rear side plate 52. The step-bent portion 52*m* has a portion bent in the plate thickness direction (arrow Y direction) of the flat surface portion 52*a* and a portion bent and extended from that portion in an insertion direction (arrow Z direction) of the rear side plate 52 into the rear bottom plate 51. The step-bent portion 52*p* has a portion bent in a plate thickness direction (arrow X direction) of the bent portion 52*b* and a portion bent and extended from that portion in the insertion direction of the rear side plate 52 into the rear bottom plate 51. In addition, a tip portion of the step-bent portion 52*m* is an inclined portion 52*m*1 inclined in a direction away from the flat surface portion 52*a* of the rear side plate 52 with respect to the insertion direction of the rear side plate 52 into the rear bottom plate 51. A tip portion of the step-bent portion 52*p* is an inclined portion 52*p*1 inclined in a direction away from the bent portion 52*b* of the rear side plate 52 with respect to the insertion direction of the rear side plate 52 into the rear bottom plate 51. In addition, a through-hole 51*n* penetrating the bent and raised portion 51*w*2 in a plate thickness direction (arrow Y direction) of the bent and raised portion 51*w*2 is formed in the bent and raised portion 51*w*2 of the rear bottom plate 51.

When the rear side plate 52 is assembled, the step-bent portions 52*m* and 52*p* of the rear side plate 52 are inserted into and engaged with the bent and raised portions 51*w*2 of the rear bottom plate 51. At this time, the inclined portions 52*m*1 and 52*p*1 of the rear side plate 52 abut on the bent and raised portions 51*w*2 of the rear bottom plate 51, such that movement of the rear side plate 52 in the arrow Z direction is guided. As a result, the bent and raised portion 51*w*2 of the rear bottom plate 51 is sandwiched from the plate thickness direction of the band and raised portion 51*w*2 by the step-bent portions 52*m* and 52*p*, and the flat surface portions 52*a* and the bent portion 52*b* in the rear side plate 52, such that a position of the rear side plate 52 with respect to the rear bottom plate 51 in the arrow X direction and the arrow Y direction is determined. In addition, the projection portion 52*n* of the rear side plate 52 engages with the through-hole 51*n* of the rear bottom plate 51. As a result, an edge portion 52*n*1 of the projection portion 52*n* abuts on an inner wall of the through-hole 51*n*, such that movement of the rear side plate 52 with respect to the rear bottom plate 51 in a direction opposite to the insertion direction is restricted. In addition, when the rear side plate 52 is inserted into the rear bottom plate 51 up to a position where a lower end portion of the rear side plate 52 abuts on a surface of the stand 33 on which the rear bottom plate 51 is placed or a position where portions of the step-bent portions 52*m* and 52*p* bent and raised from the flat surface portions 52*a* and the bent portion 52*b* abut on an upper end portion of the bent and raised portion 51*w*2 of the rear bottom plate 51, positions of the rear side plate 52 and the rear bottom plate 51 in the arrow Z direction are determined, such that a final relative position between the rear bottom plate 51 and the rear side plate 52 is determined.

Figure 7:
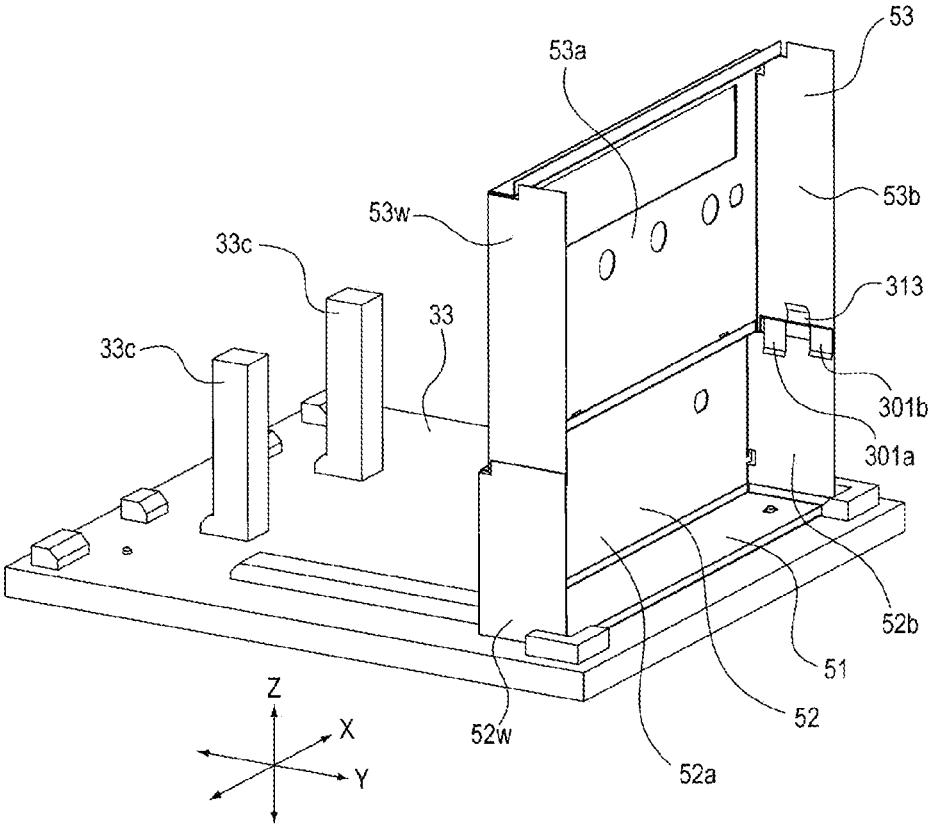
FIG. 7 is a perspective view when the rear side plate is assembled.

Next, as illustrated in FIG. 7, the rear side plate 53 is assembled. The rear side plate 53 supports the process cartridge 3 or the intermediate transfer unit 49 that has a large influence on image quality at the time of image formation. Therefore, it is particularly desirable that the rear side plate 53 is assembled with high position accuracy. Hereinafter, an assembly configuration of the rear side plate 53 will be described in detail.

As illustrated in FIG. 7, the rear side plate 53 is subjected to bending so as to have three flat surfaces. The rear side plate 53 is located on the rear side of the image forming apparatus A, and includes a support portion 53*a* supporting the process cartridge 3 or the intermediate transfer unit 49 and a bent portion 53*b* bent at a bending angle of a substantially right angle (87 to 93 degrees) with respect to the support portion 53*a* and extending rearward of the image forming apparatus A. In addition, the rear side plate 53 includes a bent portion 53*w* bent with respect to the support portion 53*a* so as to face the bent portion 53*b*.

The support portion 53*a* of the rear side plate 53 is arranged adjacent to the flat surface portion 52*a* of the rear side plate 52 in the vertical direction, and is inserted into and assembled from the flat surface portion 52*a* of the rear side plate 52 in the vertical direction (arrow Z direction).

The bent portion 53*b* of the rear side plate 53 is arranged adjacent to the bent portion 52*b* of the rear side plate 52 in the vertical direction, and is inserted into and assembled from the bent portion 52*b* of the rear side plate 52 from the vertical direction. The bent portion 53*w* of the rear side plate 53 is arranged adjacent to the bent portion 52*w* of the rear side plate 52 in the vertical direction, and is inserted into and assembled from the bent portion 52*w* of the rear side plate 52 from the vertical direction.

Figure 8A:
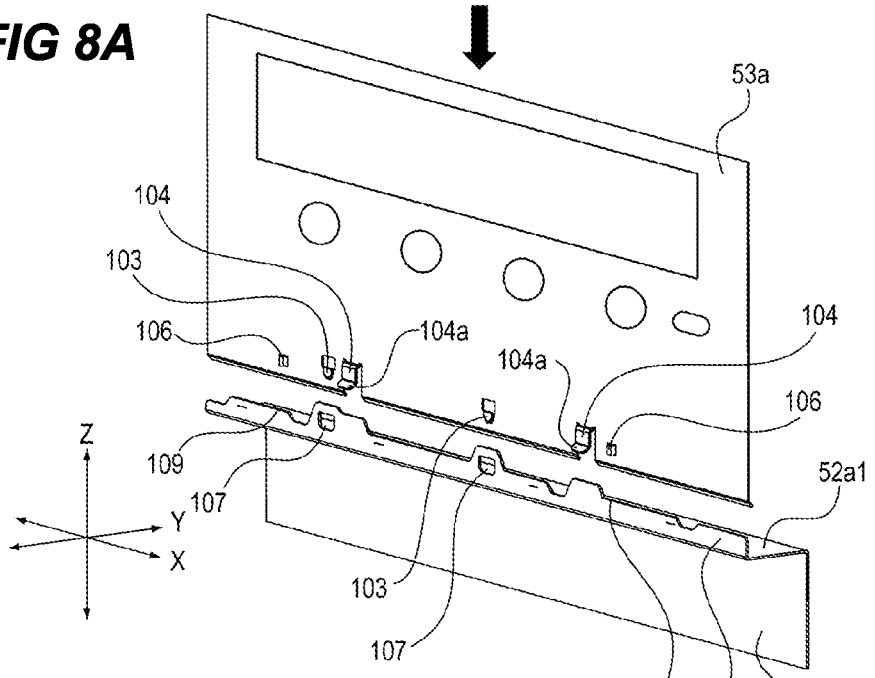
FIGS. 8A and 8B are perspective views of a support portion of the rear side plate.
Figure 8B:
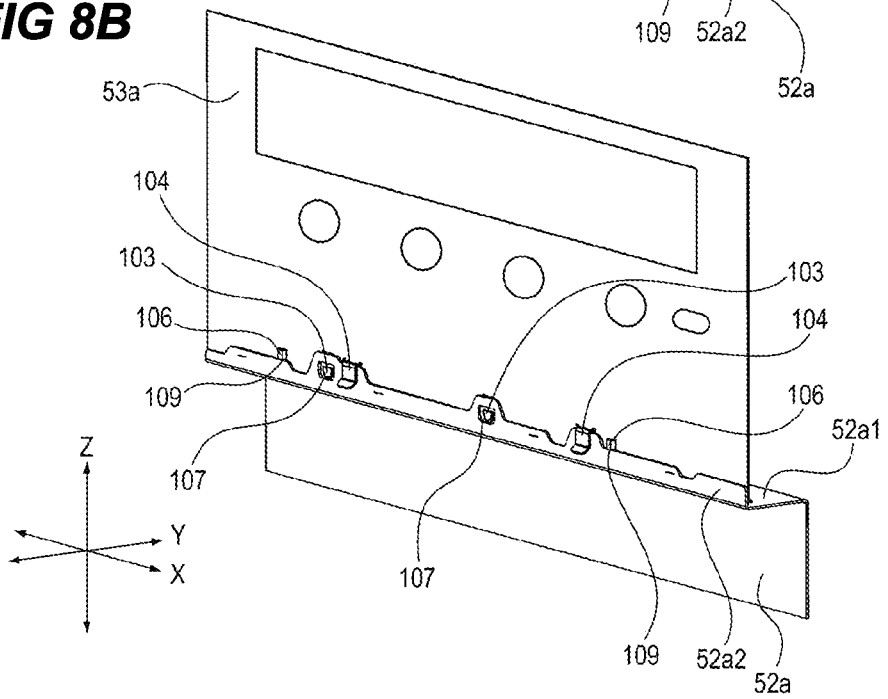

First, an assembly configuration of the flat surface portion 52*a* of the rear side plate 52 and the support portion 53*a* of the rear side plate 53 will be described. FIGS. 8A and 8B are perspective views of the flat surface portion 52*a* of the rear side plate 52 and the support portion 53*a* of the rear side plate 53. Here, FIG. 8A illustrates a state just before the flat surface portion 52*a* of the rear side plate 52 and the support portion 53*a* of the rear side plate 53 are assembled, and FIG. 8B illustrates a state in which the flat surface portion 52*a* of the rear side plate 52 and the support portion 53*a* of the rear side plate 53 are assembled.

As illustrated in FIGS. 8A and 8B, the support portion 53*a* of the rear side plate 53 is provided with two projection portions 103 protruding in a plate thickness direction (arrow Y direction) of the support portion 53*a*, two step-bent portion 104 protruding in an insertion direction (arrow Z direction) of the rear side plate 53 into the rear side plate 52, and a stopper portion 106. The stopper portion 106 (restricting portion) is a protrusion portion formed by pressing a mold (not illustrated) against the support portion 53*a* and protruding from the support portion 53*a* in the horizontal direction of the arrow Y.

The projection portion 103 (restricting portion) is formed by drawing, and the amount of protrusion from the surface of the support portion 53*a* is about 0.3 mm to 2 mm. In addition, the projection portion 103 is arranged at a position adjacent to the step-bent portion 104 in a direction (arrow X direction) orthogonal to the plate thickness direction of the rear side plate 53 and the insertion direction of the rear side plate 53 into the rear side plate 52.

The step-bent portion 104 (engaging portion) has a portion bent in the plate thickness direction (arrow Y direction) of the rear side plate 53 and a portion bent and extended from that portion in an insertion direction (arrow Z direction) into the rear side plate 52. In addition, a tip portion of the step-bent portion 104 is an inclined portion 104*a* inclined in a direction away from the support portion 53*a* of the rear side plate 53 with respect to the insertion direction of the rear side plate 53 into the rear side plate 52.

A bent portion 52*a*1 bent in the arrow Y direction and a bent and raised portion 52*a*2 bent and raised from the bent portion 52*a*1 in the arrow Z direction are formed at an upper portion of the flat surface portion 52*a* of the rear side plate 52. Two through-holes 107 penetrating the bent and raised portion 52*a*2 in a plate thickness direction (arrow Y direction) thereof are formed in the bent and raised portion 52*a*2.

When the rear side plate 53 is assembled, the step-bent portion 104 of the rear side plate 53 is inserted into and engaged with the bent and raised portions 52*a*2 (engaged portion) of the rear side plate 52. At this time, the inclined portion 104*a* of the step-bent portion 104 of the rear side plate 53 abuts on the bent and raised portion 52*a*2 of the rear side plate 52, so that the movement of the rear side plate 53 in the arrow Z direction is guided. Further, the stopper portion 106 of the rear side plate 53 abuts on an abutting portion 109, which is an edge of an upper end portion of the bent and raised portion 52*a*2 of the rear side plate 52, so that the movement of the rear side plate 52 with respect to the rear side plate 53 in the insertion direction is restricted and the position (subduction amount to the rear side plate 52 positioned lower side in the vertical direction) in the arrow Z direction with respect to the rear side plate 52 of the rear side plate 53 is determined.

In addition, when the rear side plate 53 is assembled to the rear side plate 52, the step-bent portion 104 and the support portion 53*a* on the rear side plate 53 sandwich the bent and raised portion 52*a*2 of the rear side plate 52 from the plate thickness direction, and the position of the rear side plate 53 with respect to the rear side plate 52 in the arrow Y direction is determined.

In addition, when the rear side plate 53 is assembled to the rear side plate 52, the projection portion 103 of the rear side plate 53 engages with a through-hole 107 (engaging hole) of the rear side plate 52. At this time, the projection portion 103 engages with the through-hole 107 with a gap provided between the upper end portion of the projection portion 103 and the inner wall of the through-hole 107. As a result, when the rear side plate 53 moves upward in the vertical direction and is removed from the rear side plate 52, the edge portion 103*a* of the projection portion 103 abuts on the inner wall of the through-hole 107, and the movement of the rear side plate 53 in the direction opposite to the insertion direction with respect to the rear side plate 52, that is, the movement of the rear side plate 53 upward in the vertical direction is restricted. As described above, the projection portion 103 that restricts the movement of the rear side plate 53 with respect to the rear side plate 52 in the direction opposite to the insertion direction is provided in the vicinity of the step-bent portion 104 that engages the rear side plate 52 and the rear side plate 53 with each other. As a result, it is possible to prevent the rear side plate 53 from moving with respect to the rear side plate 52 in the direction opposite to the insertion direction, such that the rear side plate 53 and the rear side plate 52 are separated from each other, resulting in deterioration of position accuracy. Therefore, the rear side plate 53 and the rear side plate 52 that constitute the frame 31 can be assembled to each other with high position accuracy.

Figure 9A:
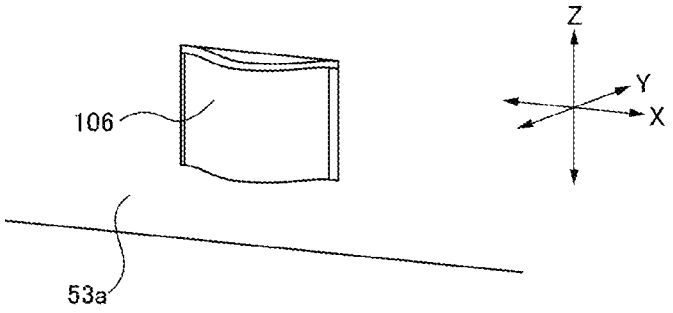
FIGS. 9A to 9C are diagrams illustrating other configurations of a stopper portion of the rear side plate.
Figure 9B:
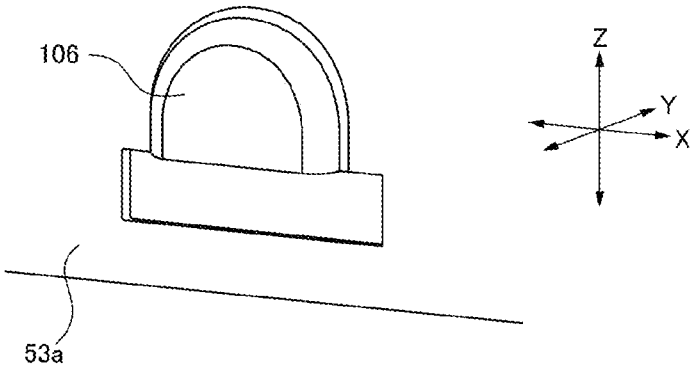
Figure 9C:
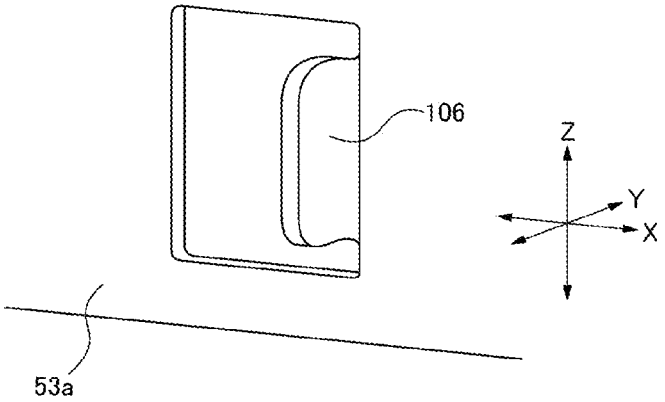

Although the present embodiment has described the configuration in which the stopper portion 106 has the cut-bent shape illustrated in FIG. 9A, the present invention is not limited thereto, and for example, other shapes such as the diaphragm shape illustrated in FIG. 9B and the bent shape illustrated in FIG. 9C may be used. Further, in the present embodiment, although the position of the rear side plate 53 at the time of assembly is stabilized by providing a plurality of stopper portions 106, the number of stopper portions 106 may be one.

Figure 10A:
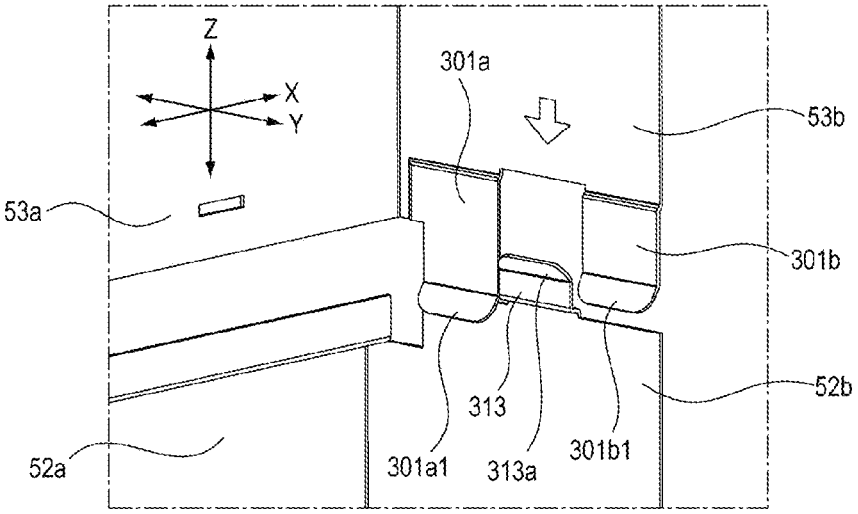
FIGS. 10A and 10B are perspectives view of a bent portion of the rear side plate.
Figure 10B:
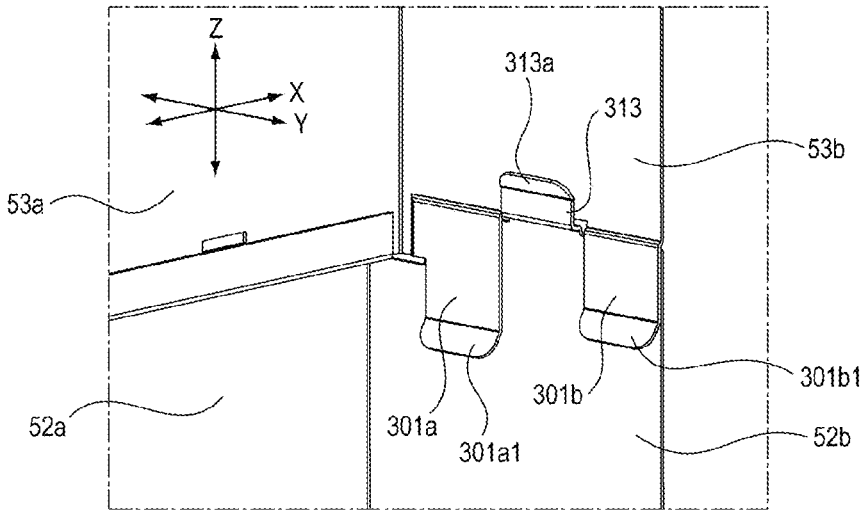

Next, an assembly configuration of the bent portion 52*b* of the rear side plate 52 and the bent portion 53*b* of the rear side plate 53 will be described. FIGS. 10A and 10B are enlarged perspective views of an engaging portion between the bent portion 52*b* of the rear side plate 52 and the bent portion 53*b* of the rear side plate 53. Here, FIG. 10A illustrates a state before the rear side plate 52 and the rear side plate 53 engage with each other, and FIG. 10B illustrates a state in which the rear side plate 52 and the rear side plate 53 engage with each other.

As illustrated in FIG. 10, the bent portion 53*b* of the rear side plate 53 and the bent portion 52*b* of the rear side plate 52 are inserted and assembled into each other. A step-bent portion 313 protruding in an insertion direction (arrow Z direction) into the bent portion 53*b* of the rear side plate 53 and inserted into and engaged with the bent portion 53*b* so as to overlap with the bent portion 53*b* of the rear side plate 53 in a plate thickness direction of the rear side plate 52 is provided at an upper portion of the bent portion 52*b* of the rear side plate 52. The step-bent portion 313 engages with the rear side plate 53 so as to be hooked on a lower end portion of the bent portion 53*b* of the rear side plate 53.

The step-bent portion 313 has a portion bent in the plate thickness direction (arrow X direction) of the bent portion 52*b* of the rear side plate 52 and a portion bent and extended from that portion in the insertion direction into the bent portion 53*b* of the rear side plate 53. In addition, a tip portion of the step-bent portion 313 is an inclined portion 313*a* that is formed to be bent from a portion of the step-bent portion 313 bent in the insertion direction into the bent portion 53*b* of the rear side plate 53 and is inclined in a direction away from the bent portion 52*b* with respect to the insertion direction into the bent portion 53*b*.

In addition, two protrusion portions 301*a* and 301*b* protruding in an insertion direction (arrow Z direction) into the bent portion 52*b* of the rear side plate 52 are provided at a lower portion of the bent portion 53*b* of the rear side plate 53. The protrusion portions 301*a* and 301*b* are inserted into and engaged with the bent portion 52*b* so as to overlap with the bent portion 52*b* of the rear side plate 52 in a plate thickness direction (arrow X direction) of the bent portion 53*b* of the rear side plate 53. In addition, the protrusion portions 301*a* and 301*b* engage with the bent portion 52*b* so as to be hooked on an upper end portion of the bent portion 52*b* of the rear side plate 52. In addition, the protrusion portion 301*b* engages with the bent portion 52*b* so as to be hooked on an upper end portion of the bent portion 52*b* of the rear side plate 52. In addition, tip portions of the protrusion portions 301*a* and 301*b* are inclined portions 301*a*1 and 301*b*1 inclined in a direction away from the bent portion 53*b* with respect to the insertion direction into the bent portion 52*b* of the rear side plate 52.

When the step-bent portion 313 engages with the bent portion 53*b* and the protrusion portions 301*a* and 301*b* engage with the bent portion 52*b*, the step-bent portion 313 and the protrusion portions 301*a* and 301*b* alternately perform engagement in a direction (arrow Y direction) orthogonal to the insertion direction and the plate thickness direction of the bent portions 52*b* and 53*b*. Specifically, the protrusion portion 301*a* is inserted into and engaged with the bent portion 52*b* on a side close to the support portion 53*a* of the rear side plate 53 with respect to the step-bent portion 313 and at a position adjacent to the step-bent portion 313, in the orthogonal direction. That is, the protrusion portion 301*a*, the step-bent portion 313, and the protrusion portion 301*b* are located so as to be arranged adjacent to each other in the direction (arrow Y direction) orthogonal to the vertical direction and the plate thickness direction. The protrusion portion 301*b* is inserted into and engaged with the bent portion 52*b* on a side far from the support portion 53*a* of the rear side plate 53 with respect to the step-bent portion 313 and at a position adjacent to the step-bent portion 313, in the orthogonal direction. With such a configuration, the bent portion 52*b* of the rear side plate 52 and the bent portion 53*b* of the rear side plate 53 are firmly engaged with and assembled to each other. In addition, since the bent portion 52*b* of the rear side plate 52 and the bent portion 53*b* of the rear side plate 53 are assembled to each other by engagement of the bent portions and the plate portions rather than engagement by a through-hole and a protrusion portion, it is not necessary to provide an extra fitting backlash and it is possible to improve positioning accuracy between the metal plates. Therefore, it is possible to achieve both easy assembly of the two metal plates constituting the frame and the improvement of the positioning accuracy between the two metal plates.

Figure 11A:
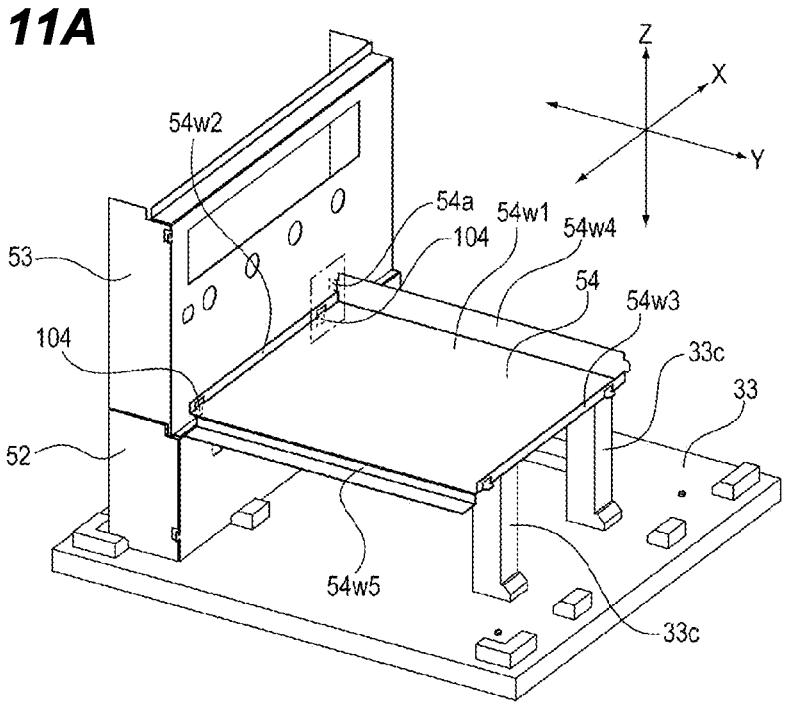
FIGS. 11A and 11B are perspective views when a middle stay is assembled.
Figure 11B:
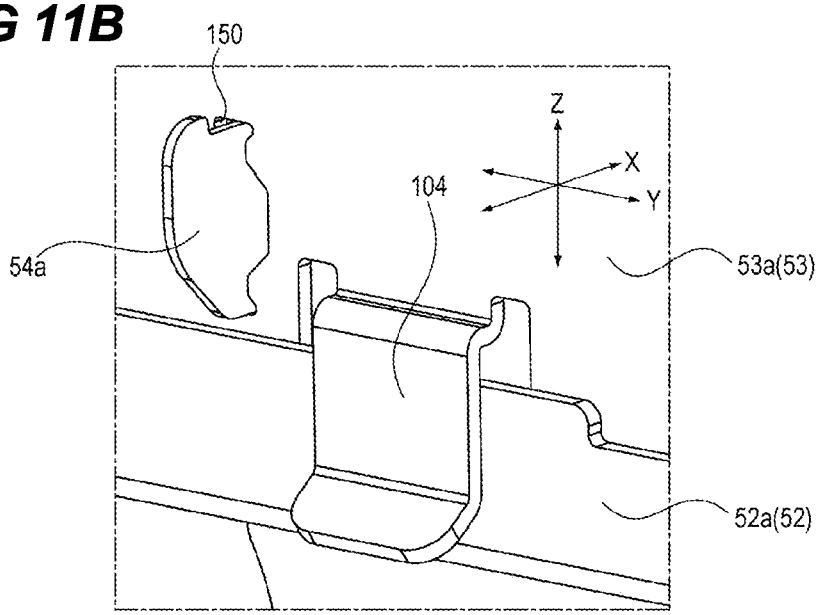

Next, as illustrated in FIGS. 11A and 11B, the middle stay 54 is assembled. The middle stay 54 is an optical stand on which the laser scanner unit 15 is placed, and is one example of the connecting member. The middle stay 54 is arranged on two support columns 33*c* provided on the stand 33, and is inserted into the support portion 53*a* of the rear side plate 53. In the present embodiment, the middle stay 54 is a member that supports the laser scanner unit 15, but may be a member that connects the front side plate 55 and the rear side plate 50 at a predetermined interval at a position between the laser scanner unit 15 and the sheet cassette 42 in the vertical direction. Further, if it is an exposure unit that exposes the photosensitive drum 6 by an LED instead of the laser scanner unit 15, the configuration may be such that it is provided between the exposure unit and the sheet cassette 42 in the vertical direction.

The middle stay 54 has a flat surface portion 54*w*1 extending in the horizontal direction, and a bent and raised portion 54*w*2 bent and raised vertically and upward from the flat surface portion 54*w*1 at one end portion of the flat surface portion 54*w*1 in the arrow Y direction. In addition, the middle stay 54 has a bent and raised portion 54*w*3 bent vertically from the flat surface portion 54*w*1 so as to face the bent and raised portion 54*w*2 and a bent and raised portion 54*w*4 bent vertically and upward from the flat surface portion 54*w*1 at one end portion of the flat surface portion 54*w*1 in the arrow X direction. In addition, the middle stay 54 has a bent portion 54*w*5 bent vertically and downward from the flat surface portion 54*w*1 at the other end portion of the flat surface portion 54*w*1 in the arrow X direction and further extending in the horizontal direction. The bent and raised portion 54*w*4 of the middle stay 54 is provided with a protrusion portion 54*a* protruding in an insertion direction (arrow Y direction) into the rear side plate 53. The protrusion portion 54*a* of the middle stay 54 is inserted into a through-hole 150 formed in the support portion 53*a* of the rear side plate 53 and penetrating the support portion 53*a* in a plate thickness direction (arrow Y direction) of the support portion 53*a*. As a result, a position of the middle stay 54 with respect to the rear side plate 53 in the arrow X direction and the arrow Z direction is determined.

Here, the configuration having one protrusion portion 54*a* of the middle stay 54 is described, but the configuration may have a plurality of protrusion portions 54*a*. Further, the middle stay 54 and the rear side plate 53 may be connected by using another engaging shape, and may be configured to determine the positions in the arrow X direction and the arrow Z direction.

Figure 12A:
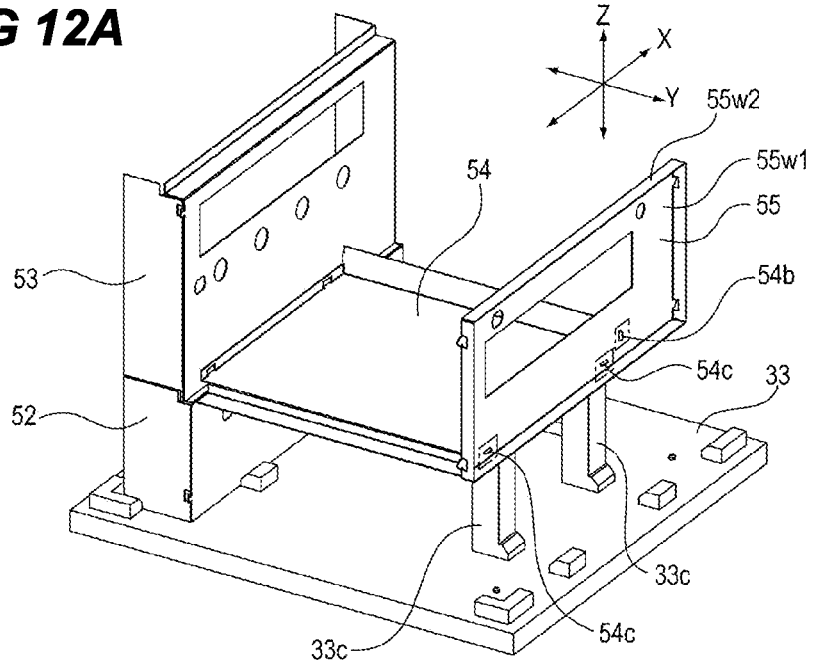
FIGS. 12A to 12C are perspective views when a front side plate is assembled.
Figure 12B:
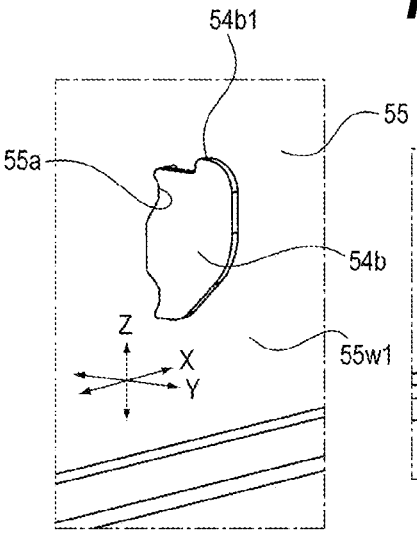
Figure 12C:
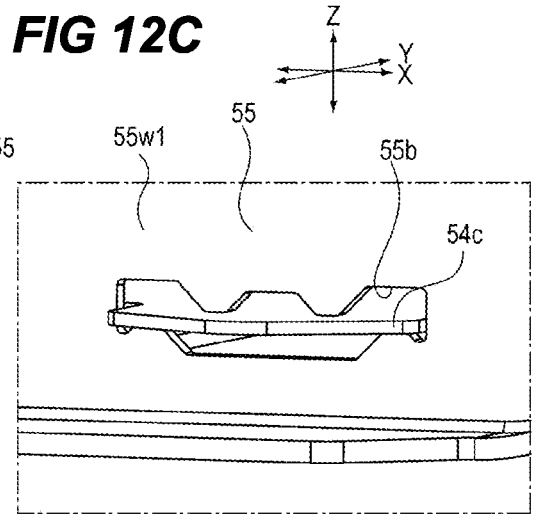

Next, as illustrated in FIGS. 12A to 12C, the front side plate 55 is assembled. The middle stay 54 is inserted into the front side plate 55. The front side plate 55 has a flat surface portion 55*w*1 extending in the vertical direction and a bent and raised portion 55*w*2 formed by bending and raising each of both end portions of the flat surface portion 55*w*1 in the arrow X direction and the arrow Y direction forward of the image forming apparatus A. Through-holes 55*a* and 55*b* penetrating the flat surface portion 55*w*1 in the plate thickness direction (arrow Y direction) thereof are formed in the flat surface portion 55*w*1 of the front side plate 55. In addition, the bent and raised portion 54*w*3 of the middle stay 54 is provided with protrusion portions 54*b* and 54*c* protruding in an insertion direction (arrow Y direction) into the front side plate 55. A tip portion of the protrusion portion 54*b* is provided with a hook portion 54*b*1 protruding upward of a base end portion.

The protrusion portion 54*b* of the middle stay 54 is inserted into the through-hole 55*a* formed in the flat surface portion 55*w*1 of the front side plate 55, and the protrusion portion 54*c* of the middle stay 54 is inserted into the through-hole 55*b* formed in the flat surface portion 55*w*1 of the front side plate 55. As a result, a position of the front side plate 55 with respect to the middle stay 54 is determined. In addition, the hook portion 54*b*1 of the protrusion portion 54*b* faces an upper portion of the through-hole 55*a* in the front side plate 55. As a result, the hook portion 54*b*1 of the middle stay 54 abuts on the flat surface portion 55*w*1 of the front side plate 55, such that movement of the middle stay 54 with respect to the front side plate 55 in a direction opposite to the insertion direction is restricted and the middle stay 54 is prevented from coming off.

Figure 13A:
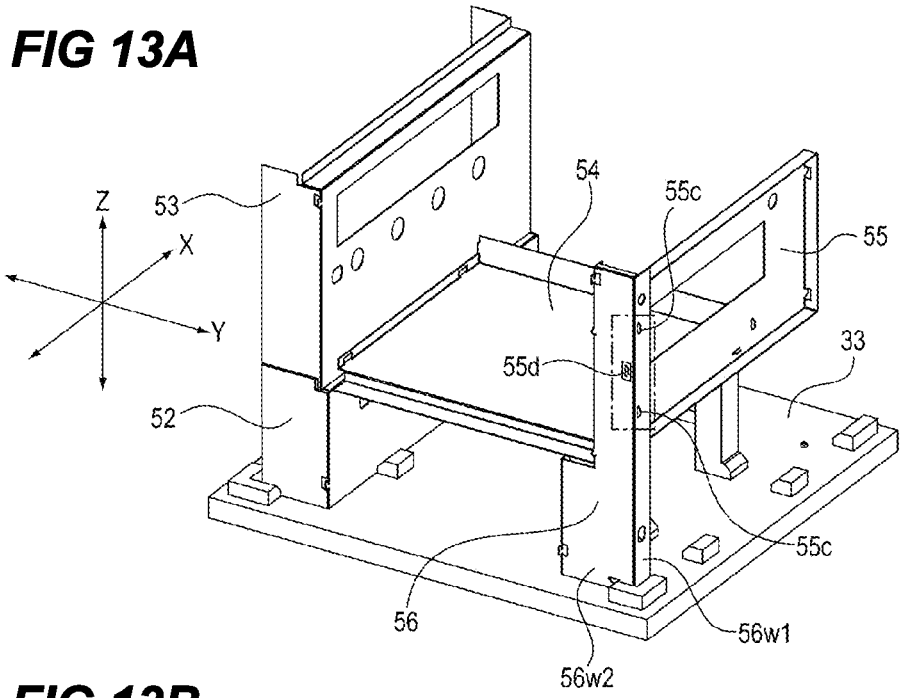
FIGS. 13A and 13B are perspective views when a left support column is assembled.
Figure 13B:
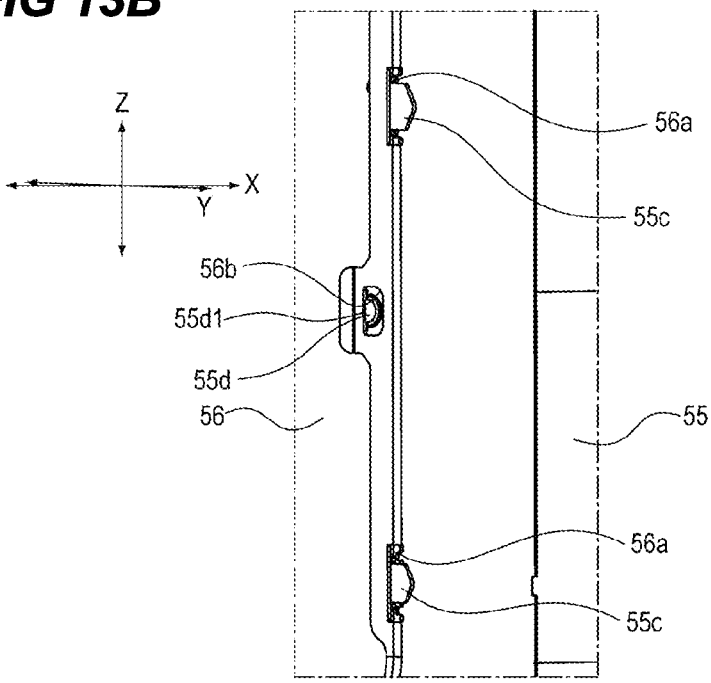

Next, as illustrated in FIGS. 13A and 13B, the left support column 56 is assembled. The left support column 56 is arranged on the stand 33. In addition, the front side plate 55 is inserted into the left support column 56. The left support column 56 is mainly formed of two flat surfaces, and has a flat surface portion 56*w*1 extending in parallel with the flat surface portion 55*w*1 of the front side plate 55 and a flat surface portion 56*w*2 bent substantially vertically from the flat surface portion 56*w*1 rearward of the image forming apparatus A. A through-hole 56*a* penetrating in the arrow Y direction is provided at the bent portion of the boundary between the flat surface portion 56*w*1 and the flat surface portion 56*w*2 of the left support column 56. In addition, the flat surface portion 56*w*2 of the left support column 56 is provided with a through-hole 56*b* penetrating the flat surface portion 56*w*2 in a plate thickness direction (arrow X direction) of the flat surface portion 56*w*2. In addition, the bent and raised portion 55*w*2 of the front side plate 55 is provided with protrusion portions 55*c* protruding in an insertion direction (arrow Y direction) into the left support column 56 and a projection portion 55*d* protruding in a plate thickness direction (arrow X direction).

The protrusion portion 55*c* of the front side plate 55 is inserted into the through-hole 56*a* formed in the left support column 56. As a result, a position of the left support column 56 with respect to the front side plate 55 is determined. In addition, the projection portion 55*d* of the front side plate 55 engages with the through-hole 56*b* of the left support column 56. As a result, an edge portion 55*d*1 of the projection portion 55*d* abuts on an inner wall of the through-hole 56*b*, such that movement of the front side plate 55 with respect to the left support column 56 in a direction opposite to the insertion direction is restricted.

Figure 14A:
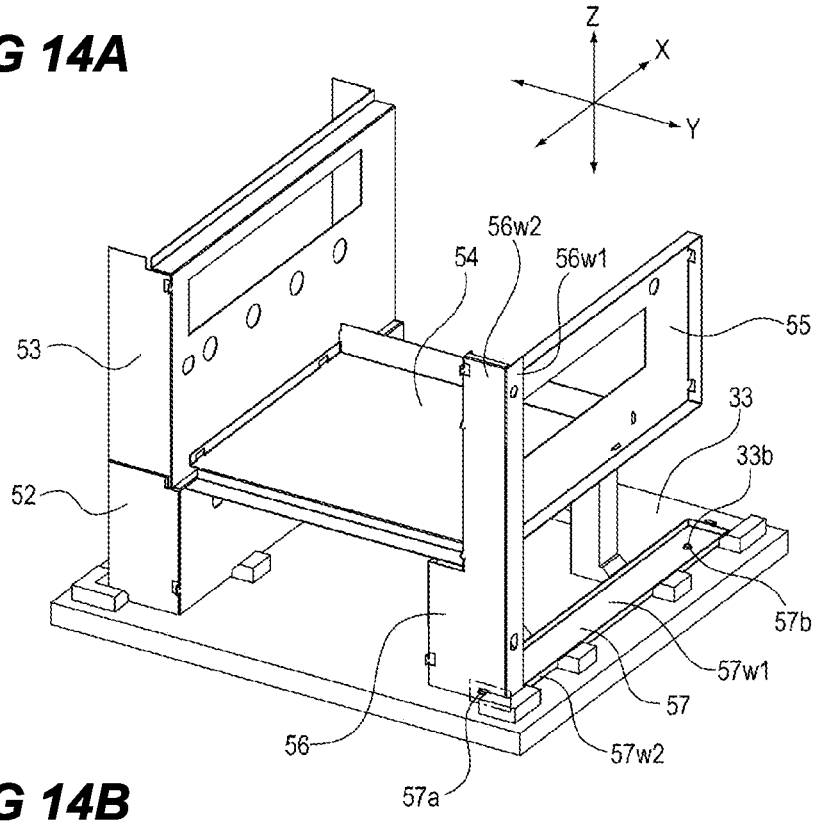
FIGS. 14A and 14B are perspective views when a front lower stay is assembled.
Figure 14B:
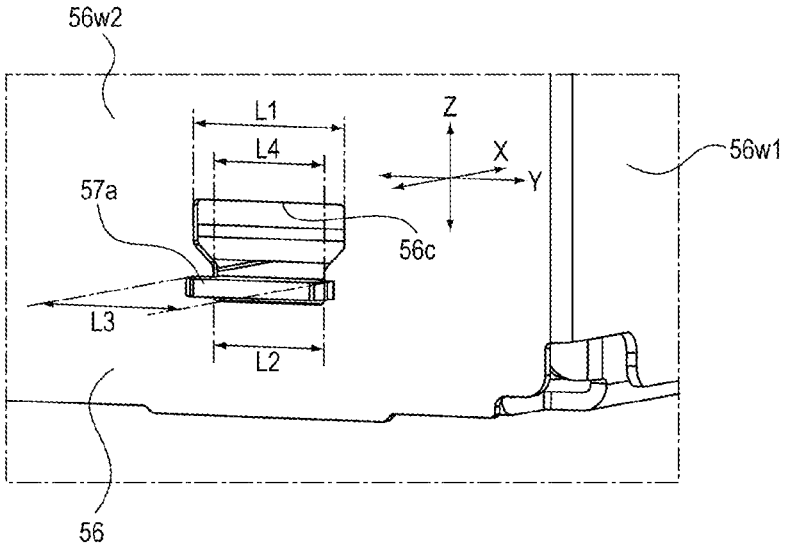

Next, as illustrated in FIGS. 14A and 14B, the front lower stay 57 is assembled. The front lower stay 57 is arranged on the stand 33, and is inserted and assembled into the left support column 56. The front lower stay 57 has a flat surface portion 57*w*1, which is a flat surface to be placed on the stand 33, and a bent and raised portion 57*w*2 formed by bending and raising each of both end portions of the flat surface portion 57*w*1 in the arrow X direction and the arrow Y direction substantially vertically and upward from the flat surface portion 57*w*1. The bent and raised portion 57*w*2 of the front lower stay 57 is provided with a protrusion portion 57*a* protruding in an insertion direction (arrow X direction) into the left support column 56. Positioning holes 57*b* penetrating the flat surface portion 57*w*1 in a plate thickness direction (arrow Z direction) of the flat surface portion 57*w*1 are formed in the flat surface portion 57*w*1 of the front lower stay 57. In addition, the flat surface portion 56*w*2 of the left support column 56 is provided with a through-hole 56*c* penetrating the flat surface portion 56*w*2 in a plate thickness direction (arrow X direction) thereof. Here, the width of the upper end portion of the through-hole 56*c* is L1 and the width of the lower end portion is L2. In addition, the width of the tip portion of the protrusion portion 57*a* is L3, and the width of the substrate portion is L4. At this time, the relationship is L1>L2, L4<L3, L1>L3>L4, L2≈L4.

The protrusion portion 57*a* of the front lower stay 57 is inserted into and engaged with a through-hole 56*c* formed in the flat surface portion 56*w*2 of the left support column 56. At this time, the protrusion portion 57*a* is inserted from an upper side of the through-hole 56*c*, and then moved to the lower end portion of the through-hole 56*c* by the force or gravity of an assembly operator. Here, when the protrusion portion 57*a* is located at a lower end portion of the through-hole 56*c*, movement of the protrusion portion 57*a* with respect to the through-hole 56*c* in a direction opposite to the insertion direction is restricted by the relationship of L3>L2. In addition, when the front lower stay 57 is arranged on the stand 33, the positioning pins 33*b* of the stand 33 are inserted into the positioning holes 57*b* of the front lower stay 57. As a result, a position of the front lower stay 57 with respect to the stand 33 is determined.

Figure 15:
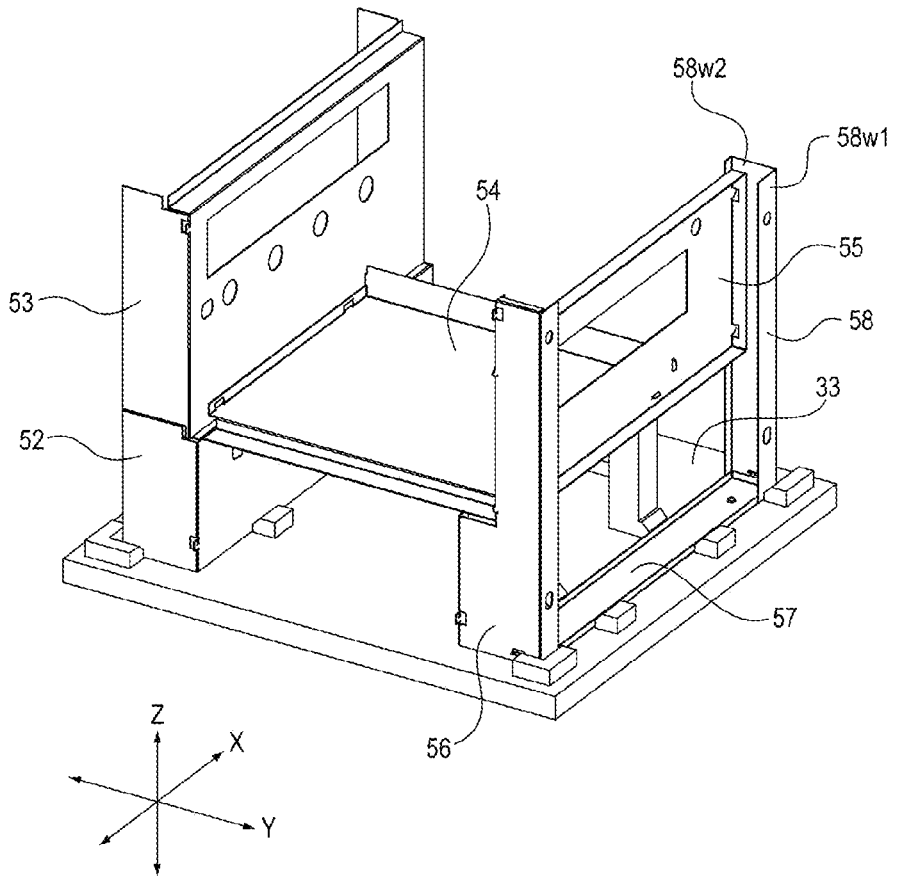
FIG. 15 is a perspective view when a right support column is assembled.

Next, as illustrated in FIG. 15, the right support column 58 is assembled. The right support column 58 is arranged on the stand 33. In addition, the front side plate 55 is inserted and assembled into the right support column 58. The right support column 58 has a flat surface portion 58*w*1 extending in parallel with the flat surface portion 55*w*1 of the front side plate 55 and a flat surface portion 58*w*2 bent substantially vertically from the flat surface portion 58*w*1 forward of the image forming apparatus A. An assembly configuration of the right support column 58 and the front side plate 55 is similar to that of the left support column 56 and the front side plate 55. That is, a through-hole (not illustrated) penetrating a bent portion of a boundary between the flat surface portion 58*w*1 and the flat surface portion 58*w*2 of the right support column 58 in the arrow Y direction is formed in the bend portion. A protrusion portion (not illustrated) formed in the bent and raised portion 55*w*2 of the front side plate 55 and protruding in an insertion direction (arrow Y direction) into the right support column 58 is inserted into this through-hole. In addition, the flat surface portion 58*w*2 of the right support column 58 is provided with a through-hole (not illustrated) penetrating the flat surface portion 58*w*2 in a plate thickness direction (arrow X direction) of the flat surface portion 58*w*2. A projection portion (not illustrated) formed in the bent and raised portion 55*w*2 of the front side plate 55 and protruding in the arrow X direction engages with this through-hole. Here, the left support column 56 and the right support column 58 are assembled after assembling the front side plate 55 to the middle stay 54, but the front side plate 55 is attached to the middle stay 54 with the left support column 56 mounted on the stand 33 in the order of assembling to the left support column 56.

At a point in time when the frame 31 is assembled up to now, the frame 31 can stand for oneself. That is, the frame 31 can stand for oneself by assembling the front side plate 55, the right support column 58, the left support column 56, the front lower stay 57, which are the frame 31 on the front surface side of the image forming apparatus A, the rear bottom plate 51 and the rear side plates 52 and 53, which are the frame on the rear surface side of the image forming apparatus A, and the middle stay 54, which is the frame 31 connecting the frame on the front surface side and the frame on the rear surface side to each other, to each other.

Figure 16A:
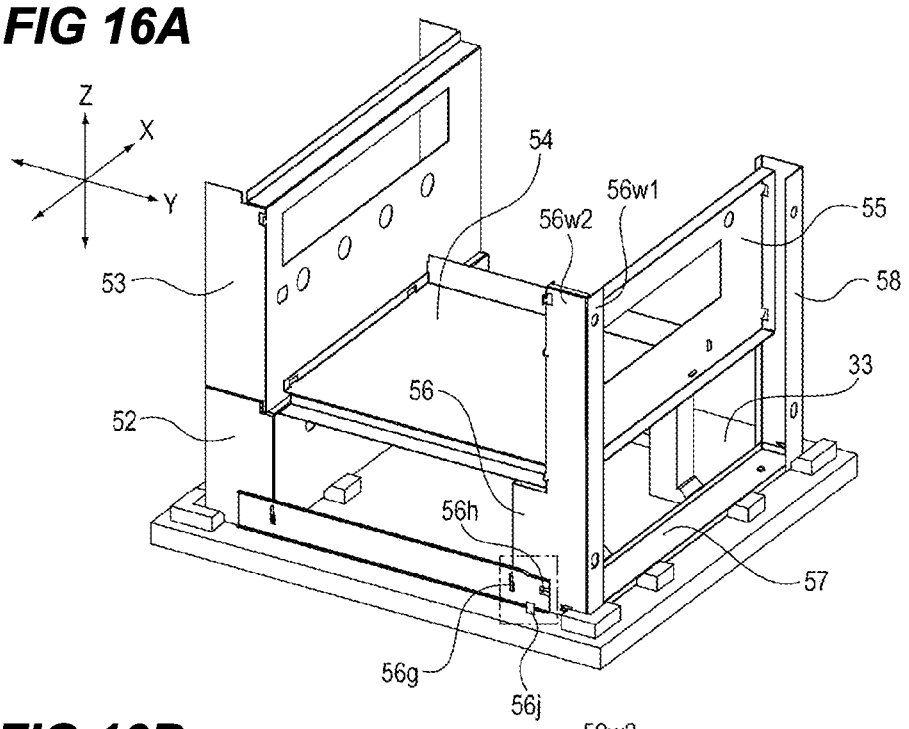
FIGS. 16A and 16B are perspective views when a left lower stay is assembled.
Figure 16B:
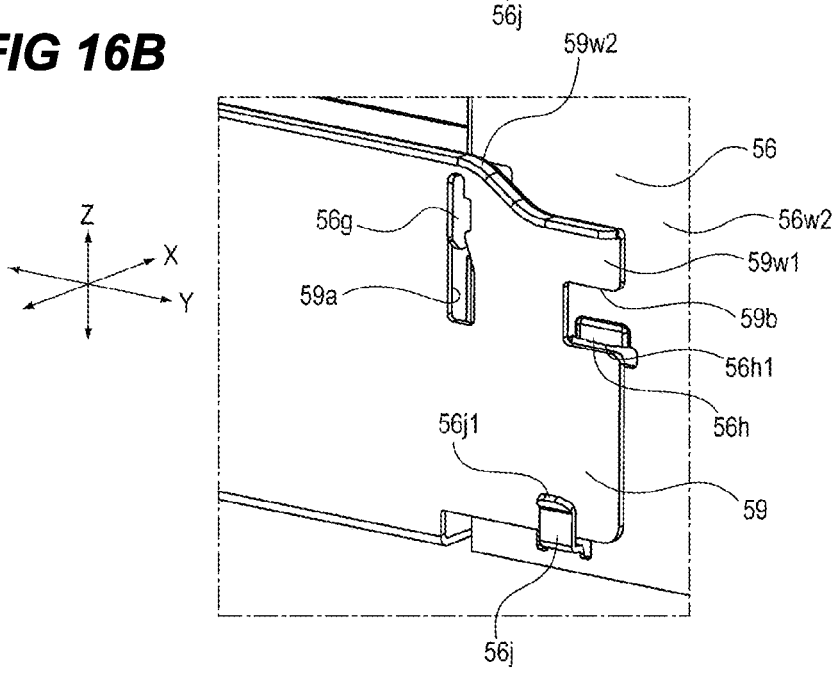

Next, as illustrated in FIGS. 16A and 16B, the left lower stay 59 is assembled. The left lower stay 59 has a flat surface portion 59*w*1 extending in parallel with the flat surface portion 56*w*2 of the left support column 56, and a bent and raised portion 59*w*2 bent in the plate thickness direction (arrow X direction) of the flat surface portion 59*w*1 at the upper part of the flat surface portion 59*w*1. The left lower stay 59, and the rear side plate 52 and the left support column 56 are inserted and assembled into each other from the vertical direction. An assembly configuration of the left lower stay 59 and the left support column 56 and an assembly configuration of the left lower stay 59 and the rear side plate 52 are similar to each other. Therefore, only the assembly configuration of the left lower stay 59 and the left support column 56 will be described here.

The flat surface portion 56*w*2 of the left support column 56 is provided with a protrusion portion 56*g* and a step-bent portion 56*j* that protrude in an insertion direction (arrow Z direction) into the left lower stay 59 and a projection portion 56*h* that protrudes in a plate thickness direction (arrow X direction) of the flat surface portion 56*w*2. The step-bent portion 56*j* has a portion bent in the plate thickness direction of the flat surface portion plate 56*w*2 and a portion bent and extended from that portion in the insertion direction into the left lower stay 59. In addition, a tip portion of the step-bent portion 56*j* is an inclined portion 56*j*1 inclined in a direction away from the flat surface portion 56*w*2 with respect to the insertion direction of the left support column 56 into the left lower stay 59. In addition, a through-hole 59*a* penetrating the flat surface portion 59*w*1 in the plate thickness direction (arrow X direction) of the flat surface portion 59*w*1 and a notch portion 59*b* notched in the flat surface direction are formed in the flat surface portion 59*w*1 of the left lower stay 59.

The protrusion portion 56*g* of the left support column 56 is inserted into and engaged with the through-hole 59*a* formed in the flat surface portion 59*w*1 of the left lower stay 59. Here, the width of the protrusion portion 56*g* in the arrow Y direction and the width of the through-hole 59*a* in the arrow Y direction are almost the same. Therefore, the protrusion portion 56*g* is inserted into the through-hole 59*a*, such that a position of the left lower stay 59 with respect to the left support column 56 in the arrow Y direction is determined.

In addition, the step-bent portion 56*j* of the left support column 56 is inserted into and engaged with a lower end portion of the flat surface portion 59*w*1 of the left lower stay 59. As a result, the flat surface portion 59*w*1 of the left lower stay 59 is sandwiched from the plate thickness direction (arrow X direction) of the flat surface portion 59*w*1 by the step-bent portion 56*j* and the flat surface portion 56*w*2 in the left support column 56, such that a position of the left lower stay 59 with respect to the left support column 56 in the arrow X direction is determined.

In addition, the projection portion 56*h* of the left support column 56 engages with the notch portion 59*b* formed in the left lower stay 59. As a result, an edge portion 56*h*1 of the projection portion 56*h* abuts on an inner wall of the notch portion 59*b*, such that movement of the left support column 56 with respect to the left lower stay 59 in a direction opposite to the insertion direction is restricted.

Figure 17A:
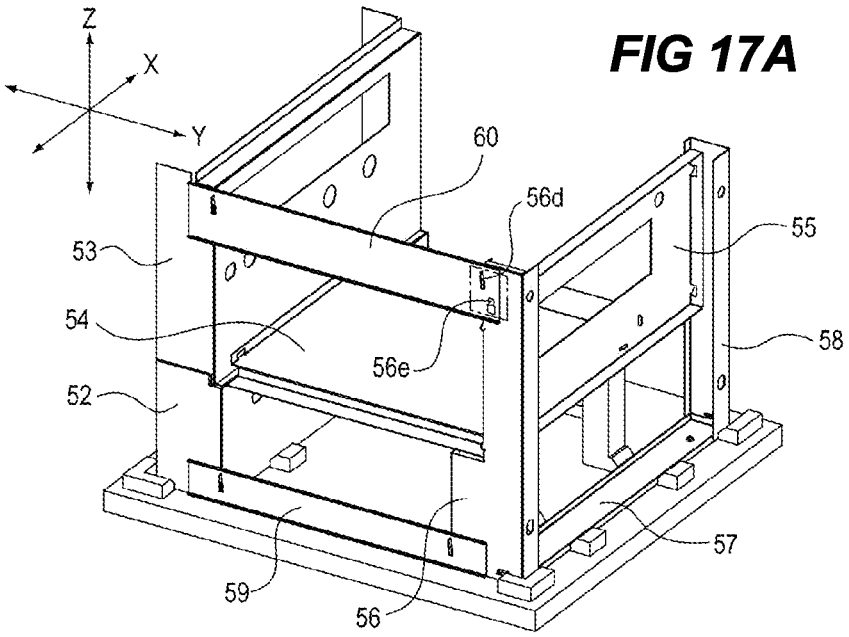
FIGS. 17A and 17B are perspective views when a left upper stay is assembled.
Figure 17B:
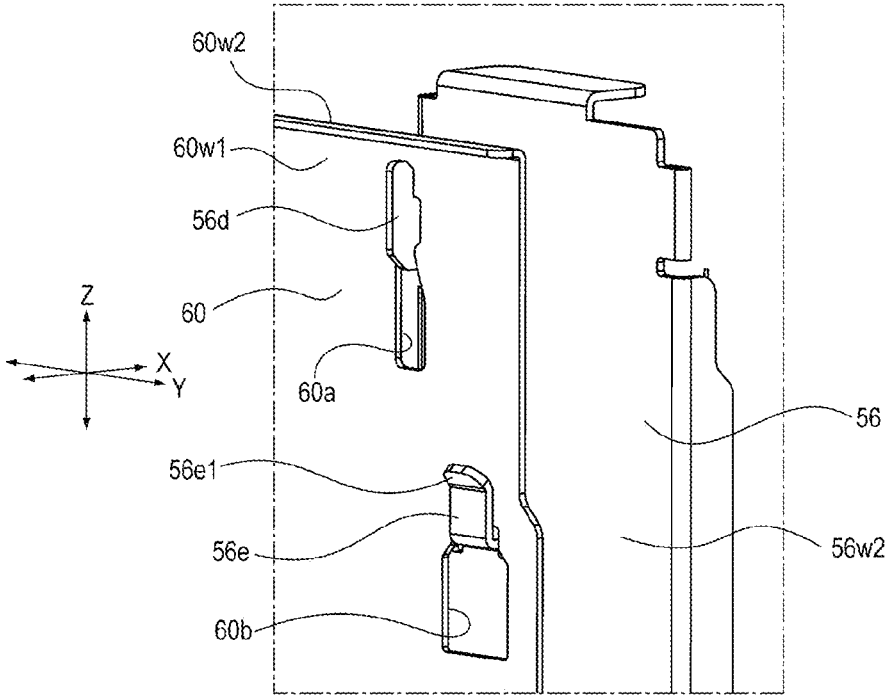

Next, as illustrated in FIGS. 17A and 17B, the left upper stay 60 is assembled. The left lower stay 59, and the rear side plate 53 and the left support column 56 are inserted and assembled into each other from the vertical direction. An assembly configuration of the left upper stay 60 and the rear side plate 53 and an assembly configuration of the left upper stay 60 and the left support column 56 are similar to each other. Therefore, only the assembly configuration of the left upper stay 60 and the left support column 56 will be described here.

A protrusion portion 56*d* and a step-bent portion 56*e* that protrude in an insertion direction (arrow Z direction) into the left upper stay 60 are formed in the flat surface portion 56*w*2 of the left support column 56. The step-bent portion 56*e* has a portion bent in the plate thickness direction (arrow X direction) of the flat surface portion plate 56*w*2 of the left support column 56 and a portion bent and extended from that portion in the insertion direction into the left upper stay 60. In addition, a tip portion of the step-bent portion 56*e* is an inclined portion 56*e*1 inclined in a direction away from the flat surface portion 56*w*2 with respect to the insertion direction of the left support column 56 into the left upper stay 60.

The left upper stay 60 has a flat surface portion 60*w*1 extending in parallel with the flat surface portion 56*w*2 of the left support column 56, and a bent and raised portion 60*w*2 bent in the plate thickness direction (arrow X direction) of the flat surface portion 60*w*1 at the upper part of the flat surface portion 60*w*1. Through-holes 60*a* and 60*b* penetrating the flat surface portion 60*w*1 in the plate thickness direction (arrow X direction) thereof are formed in the flat surface portion 60*w*1 of the left upper stay 60.

The protrusion portion 56*d* of the left support column 56 is inserted into and engaged with the through-hole 60*a* formed in the flat surface portion 60*w*1 of the left upper stay 60. Here, the width of the protrusion portion 56*d* in the arrow Y direction and the width of the through-hole 60*a* in the arrow Y direction are almost the same. Therefore, the protrusion portion 56*d* is inserted into the through-hole 60*a*, such that a position of the left upper stay 60 with respect to the left support column 56 in the arrow Y direction is determined. In addition, the step-bent portion 56*e* of the left support column 56 is inserted into and engaged with the through-hole 60*b* of the left upper stay 60. As a result, the flat surface portion 60*w*1 of the left upper stay 60 is sandwiched from the plate thickness direction (arrow X direction) of the flat surface portion 60*w*1 by the step-bent portion 56*e* and the flat surface portion 56*w*2 in the left support column 56, such that a position of the left upper stay 60 with respect to the left support column 56 in the arrow X direction is determined.

Figure 18:
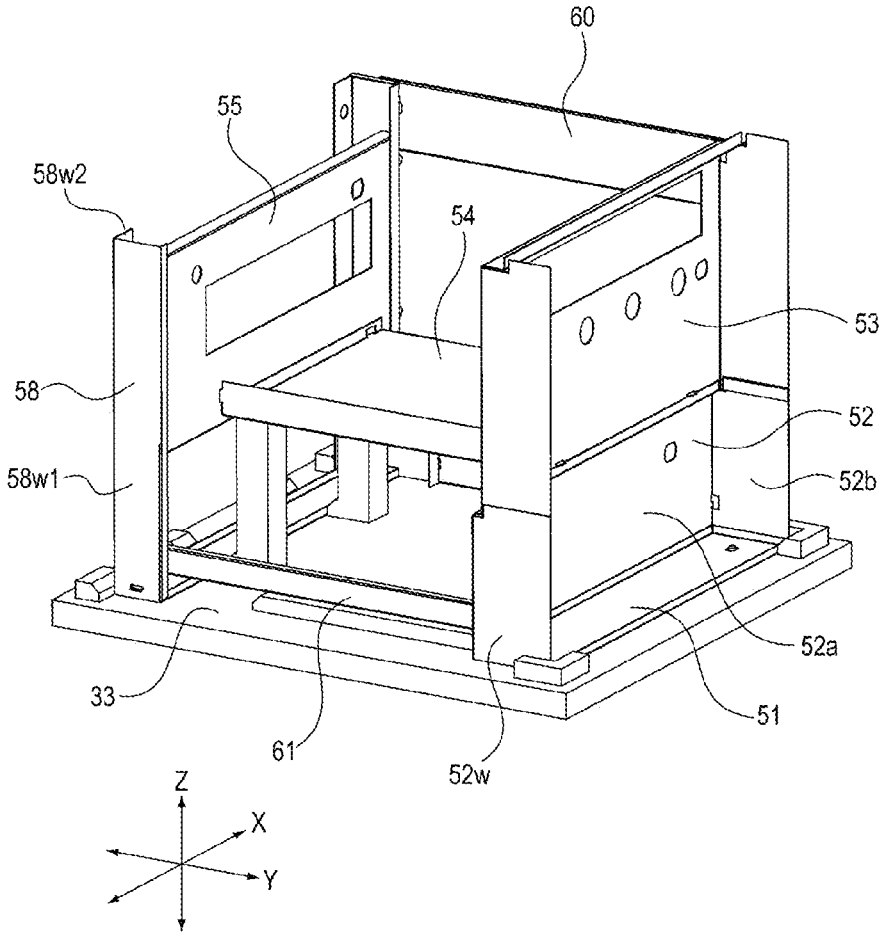
FIG. 18 is a perspective view when a right lower stay is assembled.

Next, as illustrated in FIG. 18, the right lower stay 61 is assembled. The right lower stay 61 is a member connecting between the rear side plate 52 and the right support column 58 facing each other, and is inserted and assembled into the rear side plate 52 and the right support column 58 from a front side where the right support column 58 is located, in the horizontal direction (arrow Y direction). The right lower stay 61 is a member connected to the right support column 58 and the rear side plate 52 so that an interval between the right support column 58 and the rear side plate 52 becomes a predetermined interval, and guaranteeing a conveyance property of the sheet S. In addition, since the right lower stay 61 is located in the vicinity of a right lower corner of the frame 31, the right lower stay 61 has an influence on rigidity of the frame 31. Therefore, it is particularly desirable that the right lower stay 61 is assembled with high position accuracy. Hereinafter, an assembly configuration of the right lower stay 61 will be described in detail.

Figure 19A:
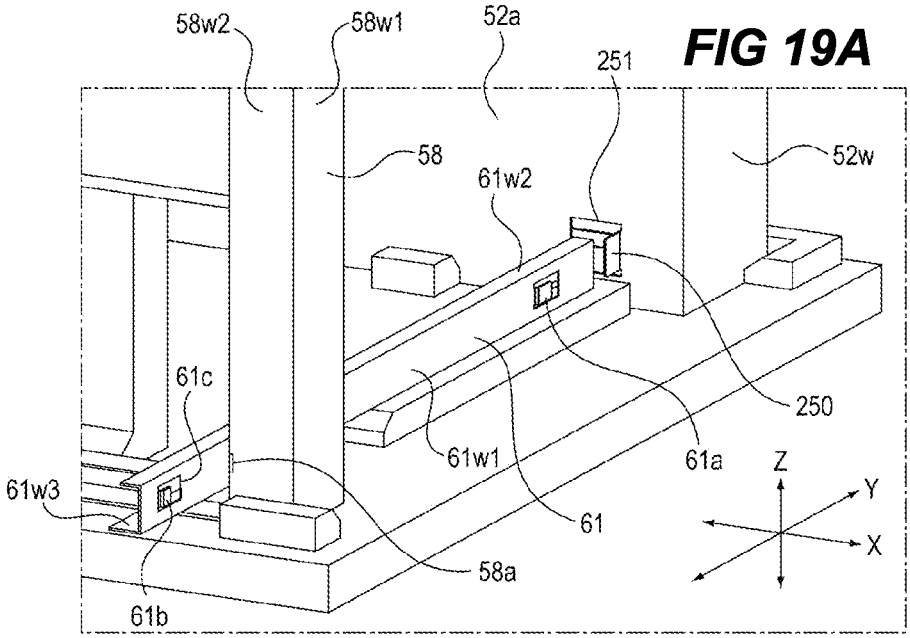
FIGS. 19A and 19B are perspective views of the right lower stay, the rear side plate, and the right support column.
Figure 19B:
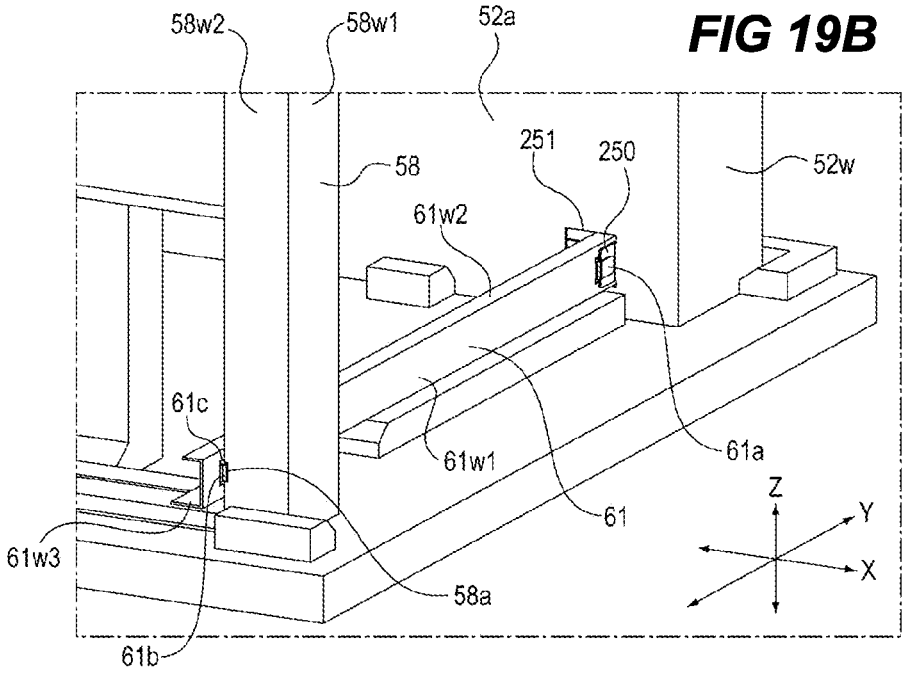

FIGS. 19A and 19B are perspective views of the right lower stay 61, the rear side plate 52, and the right support column 58. Here, FIG. 19A illustrates a state before the right lower stay 61 is assembled, and FIG. 19B illustrates a state where the right lower stay 61 is assembled. First, an assembly configuration of the right lower stay 61 and the rear side plate 52 will be described. As illustrated in FIGS. 19A and 19B, the flat surface portion 52*a* of the rear side plate 52 is provided with a bent portion 250 bent and raised toward the front surface side in the arrow Y direction. The bent portion 250 is bent and raised in a plate thickness direction of the flat surface portion 52*a* of the rear side plate 52, and is bent and raised in a direction opposite to the bent portion 52*w* with respect to the flat surface portion 52*a*. In addition, a through-hole 251 penetrating the flat surface portion 52*a* in the plate thickness direction (arrow Y direction) is formed around the bent portion 250, in the flat surface portion 52*a* of the rear side plate 52. As described above, the rear side plate 52 is formed of one metal plate, and the through-hole 251 is a hole formed when the bent portion 250 is processed.

The right lower stay 61 includes three flat surfaces and has a U-shaped cross section. The right lower stay 61 has a flat surface portion 61*w*1 extending substantially in parallel with the bent portion 52*w* of the rear side plate 52 and a flat surface portion 61*w*2 bent substantially vertically from the flat surface portion 61*w*1 in the arrow X direction at an upper portion of the flat surface portion 61*w*1. In addition, the right lower stay 61 has a flat surface portion 61*w*3 bent so as to face the flat surface portion 61*w*2 at a lower portion of the flat surface portion 61*w*1. The flat surface portion 61*w*1 of the right lower stay 61 is provided with a step-bent portion 61*a* inserted into and engaged with the bent portion 250 of the rear side plate 52. The step-bent portion 61*a* has a portion bent in the plate thickness direction (arrow X direction) of the flat surface portion 61*w*1 of the right lower stay 61 and a portion bent and extended from that portion in the insertion direction (arrow Y direction) into the rear side plate 52. The step-bent portion 61*a* is formed by forming a through-hole around the step-bent portion 61*a* at the time of being processed with respect to the flat surface portion 61*w*2 and bending the step-bent portion 61*a* with respect to the flat surface portion 61*w*2.

When the right lower stay 61 is assembled, the entirety of one end portion of the right lower stay 61 in the arrow Y direction is inserted into the through-hole 251 of the rear side plate 52, and the step-bent portion 61*a* of the right lower stay 61 is inserted into and engaged with the bent portion 250 of the rear side plate 52. As a result, the bent portion 250 of the rear side plate 52 is sandwiched from the plate thickness direction (arrow X direction) of the bent portion 250 by the step-bent portion 61*a* and the flat surface portion 61*w*1 in the right lower stay 61, such that a position of the right lower stay 61 with respect to the rear side plate 52 in the arrow X direction (plate thickness direction of the flat surface portion 61*w*1) is determined.

In addition, the flat surface portion 61*w*2, which is an upper surface of the right lower stay 61, and an inner wall of an upper side of the through-hole 251 of the rear side plate 52 face each other with a predetermined interval therebetween, and the flat surface portion 61*w*3, which is a lower surface of the right lower stay 61, and an inner wall of a lower side of the through-hole 251 are in contact with each other by a weight of the right lower stay 61. As a result, a position of the right lower stay 61 with respect to the rear side plate 52 in the vertical direction (arrow Z direction) is determined with a backlash corresponding to a predetermined interval.

Next, an assembly configuration of the right lower stay 61 and the right support column 58 will be described. As illustrated in FIGS. 19A and 19B, an insertion hole 58*a* into which a step-bent portion 61*b* of the right lower stay 61 is inserted is formed in the flat surface portion 58*w*2 of the right support column 58. Further, the right support column 58 has a flat surface portion (not illustrated) extending in the arrow Y direction behind the image forming apparatus A from the periphery of the insertion hole 58*a* in the flat surface portion 58*w*2. The flat surface portion (not illustrated) is provided with a projection portion (not illustrated) protruding in a plate thickness direction (arrow X direction) of the flat surface portion and having a substantially semi-circular shape. The projection portion (not illustrated) is formed by drawing, and is arranged at a position adjacent to the insertion hole 58*a* in an insertion direction (arrow Y direction) of the step-bent portion 61*b* into the insertion hole 58*a*.

In addition, the flat surface portion 61*w*1 of the right lower stay 61 is provided with the step-bent portion 61*b* inserted into and engaged with the insertion hole 58*a* of the right support column 58. The step-bent portion 61*b* has a portion bent in the plate thickness direction (arrow X direction) of the flat surface portion 61*w*1 and a portion bent and extended from that portion in the insertion direction (arrow Y direction) into the right support column 58.

In addition, a through-hole 61*c* penetrating the flat surface portion 61*w*1 in the plate thickness direction of the flat surface portion 61*w*1 is formed around the step-bent portion 61*b* in the flat surface portion 61*w*1 of the right lower stay 61. The through-hole 61*c* is arranged at a position adjacent to the step-bent portion 61*b* in the insertion direction of the right lower stay 61 into the right support column 58. As described above, the right lower stay 61 is formed of one metal plate, and the through-hole 61*c* is a hole formed when the step-bent portion 61*b* is processed.

When the right lower stay 61 is assembled, the step-bent portion 61*b* of the right lower stay 61 is inserted into and engaged with the insertion hole 58*a* of the right support column 58, and the projection portion (not illustrated) of the right support column 58 engages with the through-hole 61*c* of the right lower stay 61. As described above, the step-bent portion 61*b* engages with the insertion hole 58*a*, such that a position of the right lower stay 61 with respect to the right support column 58 in the arrow X direction, the arrow Y direction, and the arrow Z direction is determined. In addition, an upper surface of the step-bent portion 61*b* and an inner wall of an upper side of the insertion hole 58*a* face each other with a predetermined interval therebetween, and a lower surface of the step-bent portion 61*b* and an inner wall of a lower side of the insertion hole 58*a* face each other with a predetermined interval therebetween. As a result, a position of the right lower stay 61 with respect to the right support column 58 in a direction from the rear side toward the front side in the arrow Y direction is determined. With such a configuration, a position of the right lower stay 61 with respect to the right support column 58 in the arrow X direction, the arrow Y direction, and the vertical direction (arrow Z direction) is determined with a backlash corresponding to a predetermined interval.

In addition, in a state where the right lower stay 61 engages with the rear side plate 52 or the right support column 58, the projection portion (not shown) of the right support column 58 abuts on the inner wall of the through-hole 61*c*, such that movement of the right lower stay 61 with respect to the rear side plate 52 and the right support column 58 in a direction opposite to the insertion direction is restricted. The insertion direction of the right lower stay 61 into the rear side plate 52 and the right support column 58 is a direction orthogonal to a flat surface of the flat surface portion 52*a* of the rear side plate 52, and is a direction from the front side toward the rear side in the arrow Y direction. The opposite direction to the insertion direction of the right lower stay 61 into the rear side plate 52 and the right support column 58 is a direction orthogonal to a flat surface of the flat surface portion 52*a* of the rear side plate 52, and is a direction from the rear side toward the front side in the arrow Y direction.

Figure 20:
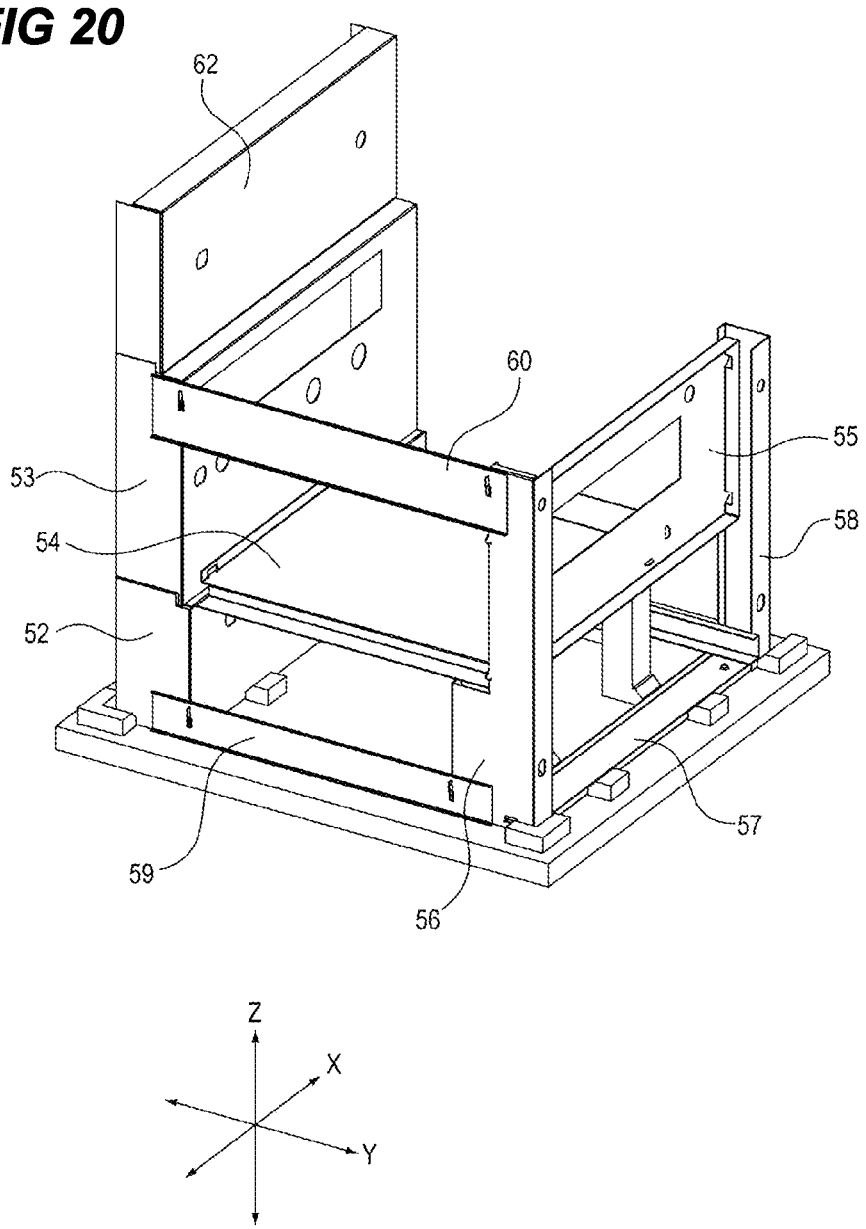
FIG. 20 is a perspective view when the rear side plate is assembled.

Next, as illustrated in FIG. 20, the rear side plate 62 is assembled. The rear side plate 62 is inserted and assembled into the rear side plate 53 from the arrow Z direction. An assembly configuration of the rear side plate 62 and the rear side plate 53 is similar to that of the rear side plate 52 and the rear side plate 53, and is an assembly configuration in which both the plates are inserted into and engaged with each other.

Figure 21A:
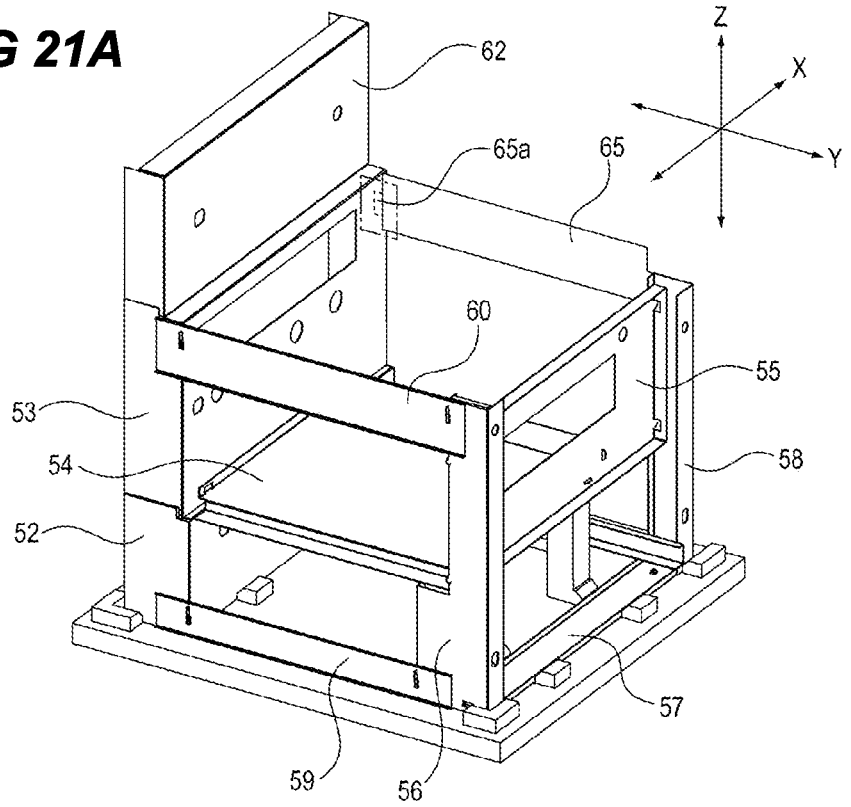
FIGS. 21A and 21B are perspective views when a right middle stay is assembled.
Figure 21B:
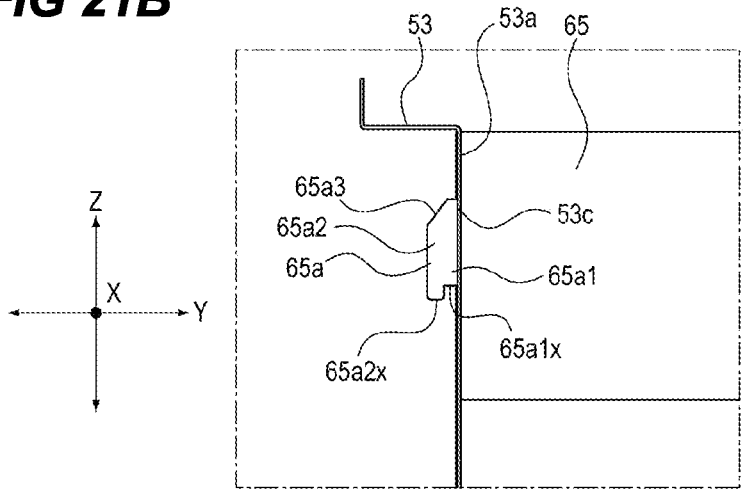

Next, as illustrated in FIGS. 21A and 21B, the right middle stay 65 is assembled. The right middle stay 65 is a plate-shaped member that is formed by one flat surface, and is a member that supports a fan cooling an end portion of the fixing portion 45 in a rotational axis direction. The right middle stay 65 is inserted and assembled into the rear side plate 53 and the right support column 58. An assembly configuration of the right middle stay 65 and the rear side plate 53 and an assembly configuration of the right middle stay 65 and the right support column 58 are similar to each other. Therefore, only the assembly configuration of the right middle stay 65 and the rear side plate 53 will be mainly described here.

A through-hole 53*c* penetrating the support portion 53*a* in the plate thickness direction (arrow Y direction) thereof is formed in the support portion 53*a* of the rear side plate 53. Note that the rear side plate 53 is a member extending in the vertical direction. In addition, the right middle stay 65 is provided with a protrusion portion 65*a* protruding in an insertion direction (arrow Y direction) into the support portion 53*a* of the rear side plate 53 and inserted into the through-hole 53*c* of the rear side plate 53 from the arrow Y direction.

The protrusion portion 65*a* is provided at a base portion 65*a*1 that fits into the through-hole 53*c* and a tip side in the insertion direction from the base 65*a*1, and has a hook portion 65*a*2 in which the lower end portion 65*a*2*x* is located at a position vertically lower than the lower end portion 65*a*1*x* of the base portion 65*a*1. In addition, the protrusion portion 65*a* has an inclined portion 65*a*3 inclined so that a height decreases from an upper end portion of the base portion 65*a*1 to an upper end portion of the hook portion 65*a*2.

When the protrusion portion 65*a* is inserted into the through-hole 53*c*, the hook portion 65*a*2, which is a tip portion of the protrusion portion 65*a*, is first inserted, the base portion 65*a*1 is inserted, and the base portion 65*a*1 is then fitted into the through-hole 53*c*. A width of the base portion 65*a*1 of the protrusion portion 65*a* in the vertical direction and a width of the through-hole 53*c* in the vertical direction are substantially the same as each other. In addition, a plate thickness of the right middle stay 65 and a width of the through-hole 53*c* in the arrow X direction are substantially the same as each other. Therefore, the base portion 65*a*1 of the protrusion portion 65*a* is fitted into the through-hole 53*c*, such that a position of the right middle stay 65 with respect to the rear side plate 53 in the vertical direction (arrow Z direction) and a position of the right middle stay 65 with respect to the rear side plate in a direction (arrow X direction) orthogonal to the insertion direction and the vertical direction are determined.

Further, in the state in which the base portion 65*a*1 of the protrusion portion 65*a* is fitted into the through-hole 53*c*, a lower end portion 65*a*2*x* of the hooking portion 65*a*2 is located at a position facing the portion below the through-hole 53*c* in the support portion 53*a* of the rear side plate 53. In the present embodiment, the lower end portion 65*a*2*x* of the hook portion 65*a*2 protrudes 2 mm downward with respect to the lower end portion 65*a*1*x* of the base portion 65*a*1 and is provided so as to be spaced by 3 mm from the facing portion of the right middle stay facing the support portion 53*a* of the rear side plate 53. Here, the plate thickness of the support portion 53*a* of the rear side plate 53 is about 1 mm, and the length of the base portion 65*a*1 of the protrusion portion 65*a* in the arrow Y direction is longer than the plate thickness of the support portion 53*a* of the rear side plate 53. As a result, even though the rear side plate 53 and the right middle stay 65 are relatively inclined during assembly, the hook portion 65*a*2 is hooked on the support portion 53*a*, such that movement of the right middle stay 65 with respect to the support portion 53*a* of the rear side plate 53 in a direction opposite to the insertion direction is restricted. Therefore, the right middle stay 65 is prevented from being separated from the rear side plate 53, such that it is possible to assemble the right middle stay 65 and the rear side plate 53 to each other with high position accuracy. In addition, since the assembly configuration of the right middle stay 65 and the rear side plate 53 and the assembly configuration of the right middle stay 65 and the right support column 58 are the same as each other as described above, the right middle stay 65 is prevented from being separated from the right support column 58, such that it is possible to improve position accuracy of the right middle stay 65 and the right support column 58.

Figure 22:
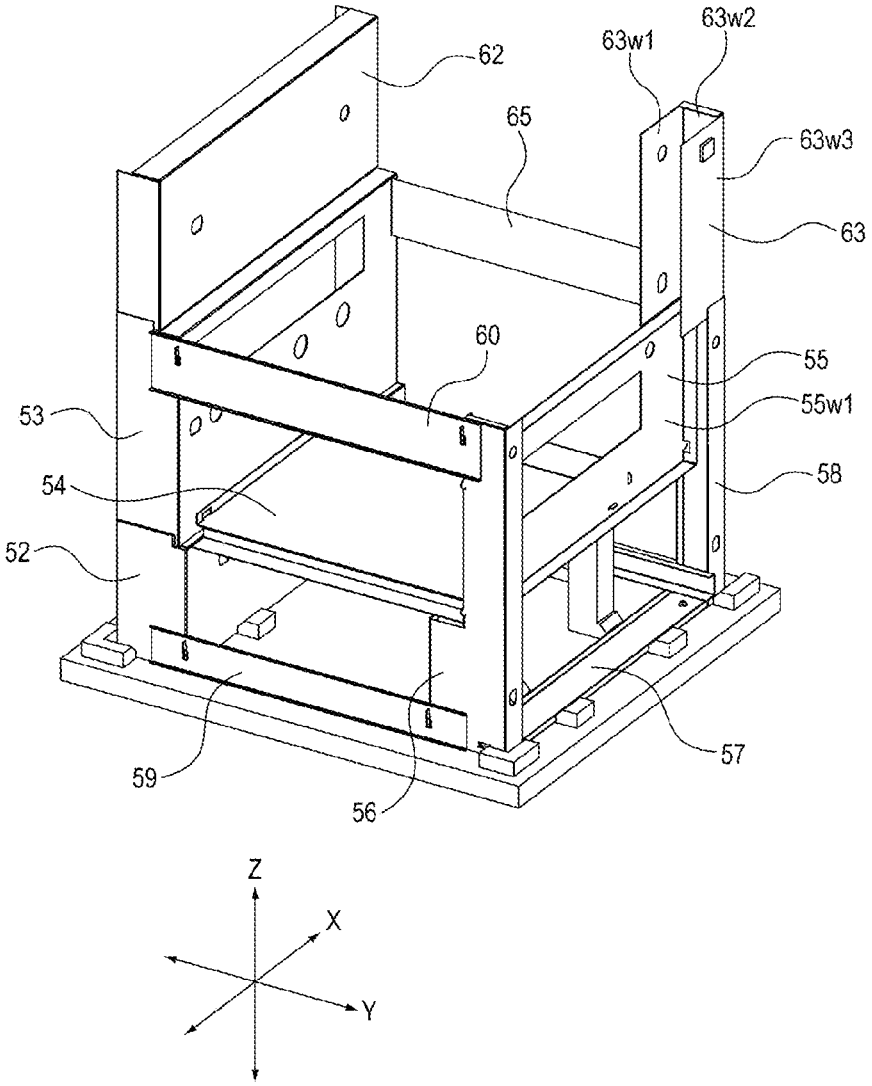
FIG. 22 is a perspective view when a right support column is assembled.

Next, as illustrated in FIG. 22, the right support column 63 is assembled. The right support column 63 faces the flat surface portion 63*w*1 extending parallel to the flat surface portion 55*w*1 of the front side plate 55, the flat surface portion 63*w*2 bent substantially perpendicular to the arrow Y direction from the flat surface portion 63*w*1, and a flat surface portion 63*w*3 bent substantially vertically so as to face the flat surface portion 63*w*1 from the flat surface portion 63*w*2. The right support column 63 and the right support column 58 are inserted and assembled into each other.

Figure 23A:
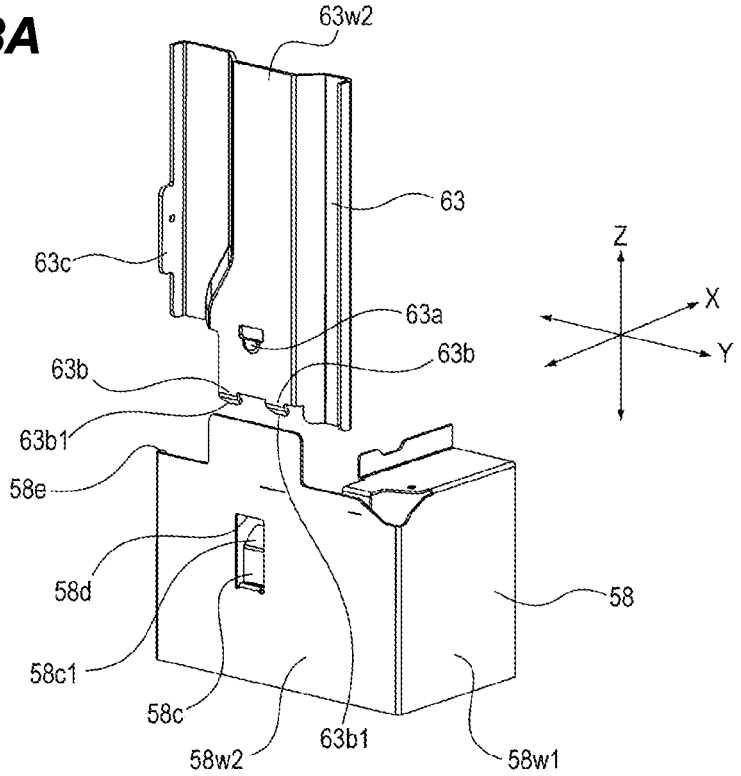
FIGS. 23A and 23B are enlarged perspective views of an engaging portion between the right support column and the right support column.
Figure 23B:
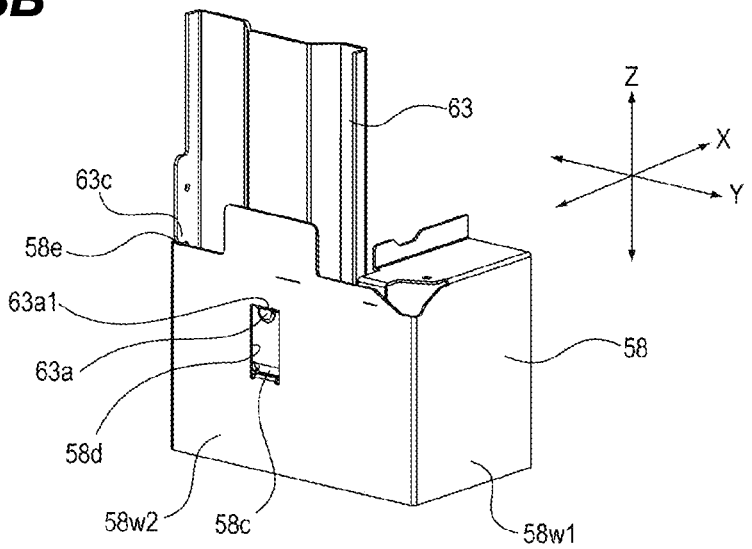

FIGS. 23A and 23B are enlarged perspective views of an engaging portion between the right support column 63 and the right support column 58. Here, FIG. 23A illustrates a state before the right support column 63 and the right support column 58 are assembled to each other, and FIG. 23B illustrates a state where the right support column 63 and the right support column 58 are assembled to each other.

As illustrated in FIGS. 23A and 23B, the flat surface portion 63*w*2 of the right support column 63 is provided with a projection portion 63*a* protruding in a plate thickness direction (arrow X direction) of the flat surface portion 63*w*2 and two protrusion portions 63*b* protruding in an insertion direction (arrow Z direction) into the right support column 58. Here, the protrusion portion 63*b* is provided below the projection portion 63*a* in the vertical direction (arrow Z direction). The projection portion 63*a* is formed by drawing, and the amount of protrusion from the surface of the flat surface portion 63*w*2 is about 0.3 mm to 2 mm. In addition, a tip portion of the protrusion portion 63*b* is an inclined portion 63*b*1 inclined in a direction away from the flat surface portion 63*w*2 with respect to the insertion direction of the right support column 63 into the right support column 58.

The flat surface portion 58*w*2 of the right support column 58 is provided with a step-bent portion 58*c* protruding in an insertion direction (arrow Z direction) of the right support column 58 into the right support column 63. In addition, a through-hole 58*d* penetrating the flat surface portion 58*w*2 in a plate thickness direction (arrow X direction) of the flat surface portion 58*w*2 is formed at a position adjacent to the step-bent portion 58*c* in the insertion direction of the right support column 58 with respect to the right support column 63. The step-bent portion 58*c* has a portion bent in the plate thickness direction of the flat surface portion 58*w*2 and a portion bent and extended from that portion in the insertion direction into the right support column 63. In addition, a tip portion of the step-bent portion 58*c* is an inclined portion 58*c*1 inclined in a direction away from the flat surface portion 58*w*2 with respect to the insertion direction of the right support column 58 into the right support column 63.

When the right support column 63 is assembled to the right support column 58, the inclined portion 58*c*1 of the step-bent portion 58*c* of the right support column 58 abuts on the flat surface portion 63*w*2 of the right support column 63, and the inclined portion 63*b*1 of the protrusion portion 63*b* of the right support column 63 abuts on the flat surface portion 58*w*2 of the right support column 58. As a result, movement of the right support column 63 and the right support column 58 in the arrow Z direction is guided, and the flat surface portion 63*w*2 and the flat surface portion 58*w*2 move in a predetermined positional relationship. In addition, a lower end portion of a stopper portion 63*c* of the right support column 63 abuts abutting portion 58*e*, which is an upper end portion of the flat surface portion 58*w*2 of the right support column 58, such that movement of the right support column 63 with respect to the right support column 58 in the insertion direction (arrow Z direction) is restricted.

When the right support column 63 is assembled to the right support column 58, the step-bent portion 58*c* of the right support column 58 is inserted into the flat surface portion 63*w*2 of the right support column 63 and engages with a lower end portion of the flat surface portion 63*w*2. As a result, the flat surface portion 63*w*2 of the right support column 63 is sandwiched from the plate thickness direction (arrow X direction) of the flat surface portion 63*w*2 by the step-bent portion 58*c* and the flat surface portion 58*w*2 in the right support column 58, such that a position of the right support column 63 with respect to the right support column 58 in the arrow X direction is determined.

In addition, the projection portion 63*a* of the right support column 63 engages with the through-hole 58*d* formed in the right support column 58. As a result, an edge portion 63*a*1 of the projection portion 63*a* abuts on an inner wall of the through-hole 58*d*, such that movement of the right support column 63 with respect to the right support column 58 in a direction opposite to the insertion direction is restricted. Here, the through-hole 58*d* is arranged at a position adjacent to the step-bent portion 58*c* in the insertion direction of the right support column 58 into the right support column 63. Therefore, the projection portion 63*a* engaged with the through-hole 58*d* and the step-bent portion 58*c* are arranged at positions adjacent to each other in the insertion direction.

A configuration in which the edge portion 63*a*1 of the projection portion 63*a* abuts on the inner wall of the through-hole 58*d* formed when the step-bent portion 58*c* is processed has been described in the present embodiment, but a configuration in which the edge portion 63*a*1 of the projection portion 63*a* abuts on an inner wall of another through-hole different from the through-hole 58*d* may be adopted. As a result, the movement of the right support column 63 with respect to the right support column 58 in the direction opposite to the insertion direction is restricted.

In addition, in a direction (arrow Y direction) orthogonal to the plate thickness direction of the flat surface portion 63*w*2 and the insertion direction into the right support column 58, the two protrusion portions 63*b* of the right support column 63 engage with the step-bent portion 58*c* so as to sandwich the step-bent portion 58*c* of the right support column 58 therebetween. As a result, a position of the right support column 63 with respect to the right support column 58 in the orthogonal direction is determined.

As described above, the projection portion 63*a* restricting the movement of the right support column 63 with respect to the right support column 58 in the direction opposite to the insertion direction is provided in the vicinity of the step-bent portion 58*c* engaging the flat surface portion 63*w*2 of the right support column 63 and the flat surface portion 58*w*2 of the right support column 58 with each other. As a result, it is possible to prevent the right support column 63 from moving with respect to the right support column 58 in the direction opposite to the insertion direction, such that the right support column 63 and the right support column 58 are separated from each other, resulting in deterioration of position accuracy. Therefore, the right support column 63 and the right support column 58 that constitute the frame 31 can be assembled to each other with high position accuracy.

Figure 24A:
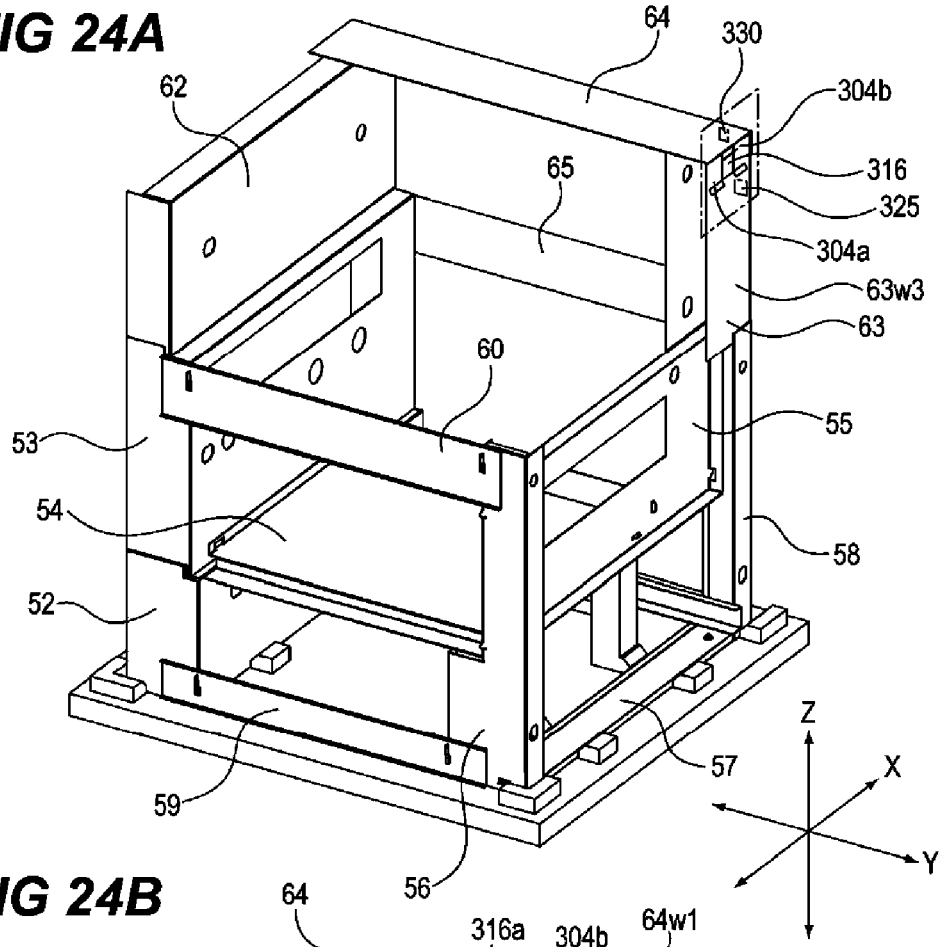
FIGS. 24A and 24B are perspective views when a right upper stay is assembled.
Figure 24B:
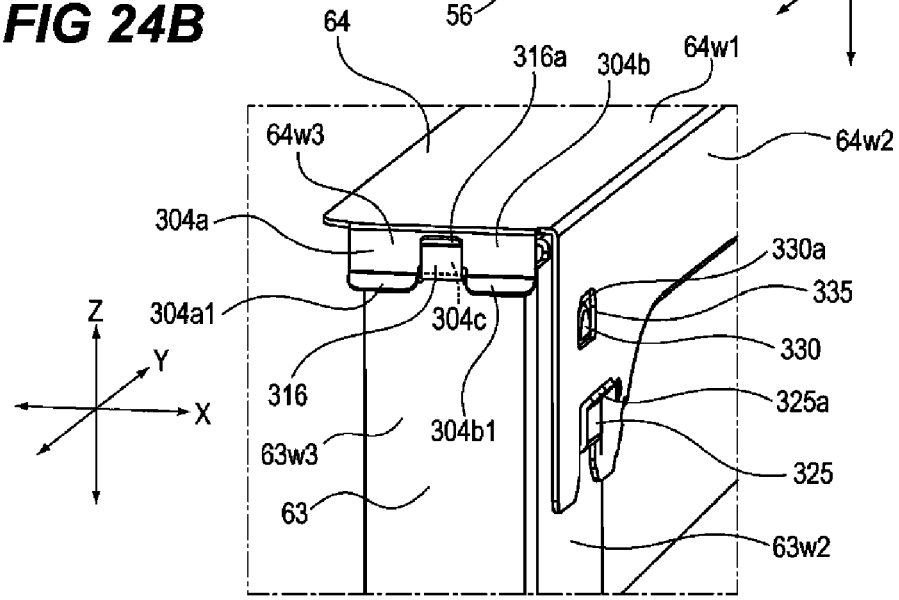

Next, as illustrated in FIGS. 24A and 24B, the right upper stay 64 is assembled. The right upper stay 64 has a flat surface portion 64*w*1 extending in the horizontal direction, a flat surface portion 64*w*2 formed by bending one end portion of the flat surface portion 64*w*1 in the arrow X direction substantially vertically in the vertical direction, and a flat surface portion 64*w*3 formed by bending one end portion of the flat surface portion 64*w*1 in the arrow Y direction substantially vertically in the vertical direction. In addition, the right upper stay 64 has a flat surface portion (not illustrated) formed by bending the other end portion of the flat surface portion 64*w*1 in the arrow Y direction substantially vertically in the vertical direction. The right upper stay 64, and the rear side plate 62 and the right support column 63 are inserted and assembled into with each other. An assembly configuration of the right upper stay 64 and the rear side plate 62 and an assembly configuration of the right upper stay 64 and the right support column 63 are similar to each other. Therefore, only the assembly configuration of the right upper stay 64 and the right support column 63 will be described here.

The flat surface portion 64*w*3 of the right upper stay 64 includes three bent portions 304*a*, 304*b*, and 304*c* bent from the flat surface portion 64*w*1 in an insertion direction (arrow Z direction) into the right support column 63. That is, when the flat surface portion 64*w*3 is divided into three portions in the arrow X direction, there are the bent portions 304*a*, 304*b*, and 304*c*. The bent portion 304*c* is shown in phantom (dashed) lines, for the reason that when assembled, bent portion 304*c* is positioned behind step-bent portion 316. The bent portion 304*c* is arranged at a position between the bent portion 304*a* and the bent portion 304*b* in the arrow X direction, and a length of the bent portion 304*c* in the arrow Z direction is smaller than that of the bent portions 304*a* and 304*b* in the arrow Z direction. In addition, the bent portions 304*a* and 304*b* have the same length in the arrow Z direction, and tip portions of the bent portions 304*a* and 304*b* are inclined portions 304*a*1 and 304*b*1 inclined in a direction away from the flat surface portion 64*w*1 with respect to the insertion direction into the right support column 63.

In addition, the flat surface portion 63*w*3 of the right support column 63 is provided with a step-bent portion 316 protruding in an insertion direction (vertical direction and arrow Z direction) into the right upper stay 64 and inserted into and engaged with the right upper stay 64 so as to overlap with the bent portion 304*c* of the right upper stay 64 in a plate thickness direction (arrow Y direction) of the flat surface portion 63*w*3. In addition, the flat surface portion 63*w*2 of the right support column 63 is provided with a step-bent portion 325 protruding in the insertion direction into the right upper stay 64 and inserted into and engaged with the flat surface portion 64*w*2 so as to overlap with the flat surface portion 64*w*2 of the right upper stay 64 in a plate thickness direction (arrow X direction) of the flat surface portion 63*w*2. In addition, the flat surface portion 63*w*2 of the right support column 63 is provided with a projection portion 330 protruding in a plate thickness direction (arrow X direction) of the flat surface portion 63*w*2.

The step-bent portion 316 has a portion bent in the plate thickness direction (arrow Y direction) of the flat surface portion 63*w*3 of the right support column 63 and a portion bent and extended from that portion in the insertion direction (arrow Z direction) into the right upper stay 64. In addition, a tip portion of the step-bent portion 316 is an inclined portion 316*a* formed by further bending a portion of the step-bent portion 316 bent in the insertion direction into the right upper stay 64 and inclined in a direction away from the flat surface portion 63*w*3 with respect to the insertion direction into the right upper stay 64.

The step-bent portion 325 has a portion bent in the plate thickness direction (arrow X direction) of the flat surface portion 63*w*2 of the right support column 63 and a portion bent and extended from that portion in the insertion direction (arrow Z direction) into the right upper stay 64. In addition, a tip portion of the step-bent portion 325 is an inclined portion 325*a* formed by further bending a portion of the step-bent portion 325 bent in the insertion direction into the right upper stay 64 and inclined in a direction away from the flat surface portion 63w2 with respect to the insertion direction into the right upper stay 64.

When the right upper stay 64 is assembled to the right support column 63, the inclined portions 316a and 325a of the step-bent portions 316 and 325 of the right support column 63 abut on the right upper stay 64, and the inclined portion 304a1 and 304b1 of the bent portions 304a and 304b of the right upper stay 64 abut on the right support column 63. As a result, movement of the right upper stay 64 and the right support column 63 is guided, such that the right upper stay 64 and the right support column 63 move in a predetermined positional relationship.

When the step-bent portion 316 engages with the bent portion 304c of the right upper stay 64 and the bent portions 304a and 304b engage with the flat surface portion 63w3 of the right support column 63, the step-bent portion 316 and the bent portions 304a and 304b alternately perform engagement in a direction (arrow X direction) orthogonal to the insertion direction of the right support column 63 into the right upper stay 64 and the plate thickness direction. Specifically, the bent portion 304a engages with the flat surface portion 63w3 of the right support column 63 at a position adjacent to the step-bent portion 316 in the arrow X direction. In addition, the bent portion 304b engages with the flat surface portion 63w3 of the right support column 63 on a side opposite to a side where the bent portion 304a is arranged, with respect to the step-bent portion 316, and at a position adjacent to the step-bent portion 316, in the arrow X direction. With such a configuration, the right upper stay 64 and the right support column 63 are firmly engaged with and assembled to each other.

In addition, the projection portion 330 of the right support column 63 engages with a through-hole 335 formed in the flat surface portion 64w2 of the right upper stay 64 and penetrating the flat surface portion 64w2 in a plate thickness direction (arrow X direction) of the flat surface portion 64w2. As a result, an edge portion 330a of the projection portion 330 abuts on an inner wall of the through-hole 335, such that movement of the right upper stay 64 with respect to the right support column 63 in a direction opposite to the insertion direction is restricted.

As described above, the respective metal plates constituting the frame 31 are assembled. The frame 31 assembled in the assembling process as described above is configured to be able to stand for oneself. Therefore, the frame 31 can be detached from the stand 33 by grasping the rear side plate 52, the left support column 56, the right support column 58, and the like, of the frame 31 and lifting the frame 31.

<Frame Fixing Process>

Next, a process of fixing the frame 31 assembled in the assembling process described above will be described.

Figure 25:
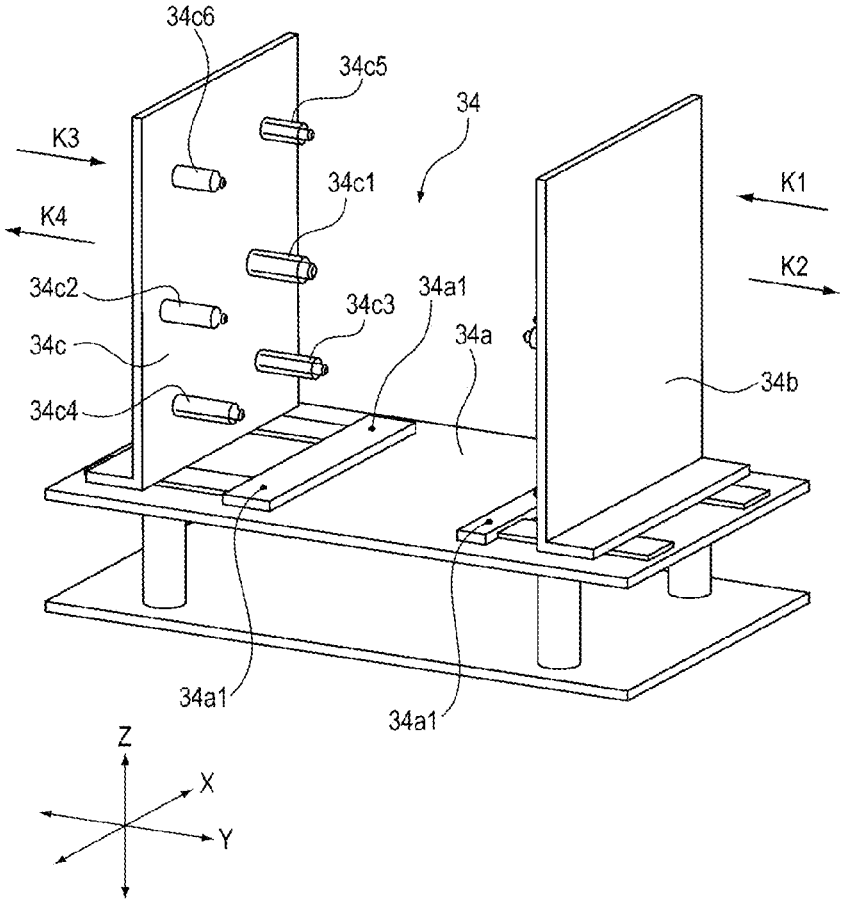
FIG. 25 is a perspective view of a jig used for fixing the frame.

FIG. 25 is a perspective view of the jig 34 used in the fixing process. As illustrated in FIG. 25, the jig 34 includes a base 34a, a front side support portion 34b (third jig), and a rear side support portion 34c (second jig). The base 34a has a cylindrical positioning pin 34a1. The front side support portion 34b has cylindrical positioning pins 34b1 to 34b7 (see FIG. 28). The rear side support portion 34c has cylindrical positioning pins 34c1 to 34c6. The front side support portion 34b and the rear side support portion 34c are configured to be slidable with respect to the base 34a. The front side support portion 34b slides in the directions of arrows K1 and K2, and the rear side support portion 34c slides in the directions of arrows K3 and K4.

Figure 26:
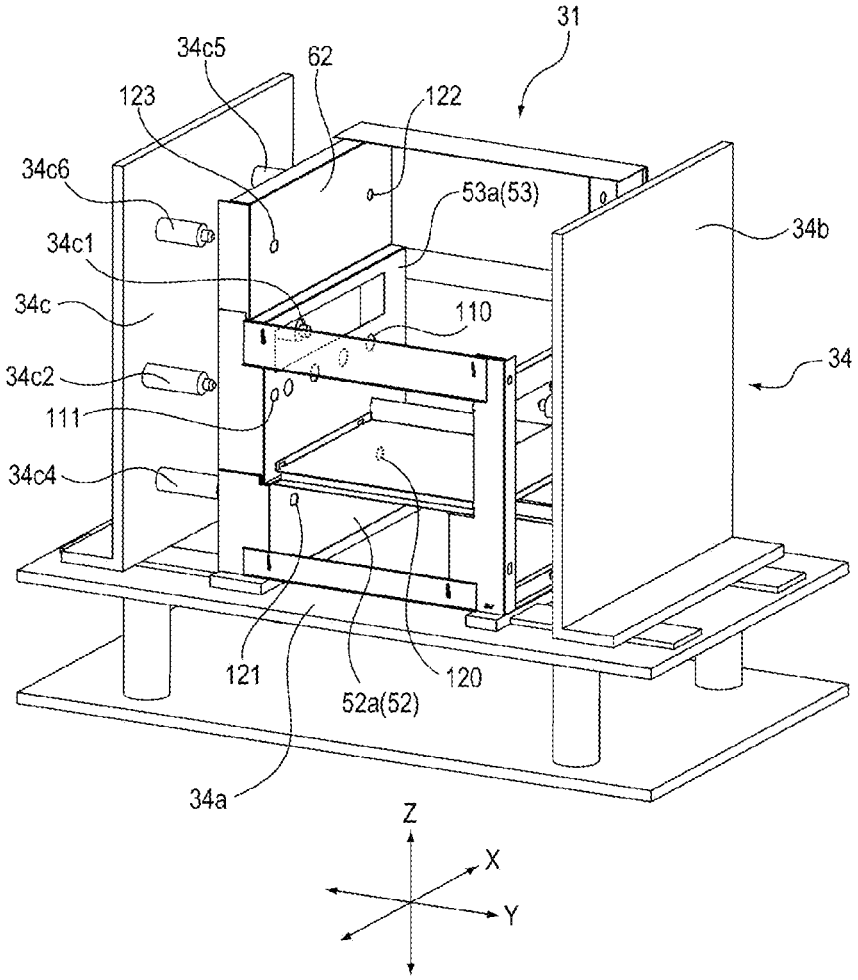
FIG. 26 is a perspective view of the frame and the jig.

FIG. 26 is a perspective view of the frame 31 assembled in the assembling process described above and the jig 34. As illustrated in FIG. 26, after the assembling step, the frame 31 is removed from the stand 33 by an operator performing the fixing step and placed on the base 34a of the jig 34. At this time, the positioning pins 34a1 of the base 34a are inserted into the positioning holes 51a of the rear bottom plate 51 of the frame 31 or the positioning holes 57b of the front lower stay 57, such that a position of the frame 31 with respect to the base 34a is determined.

Figure 27:
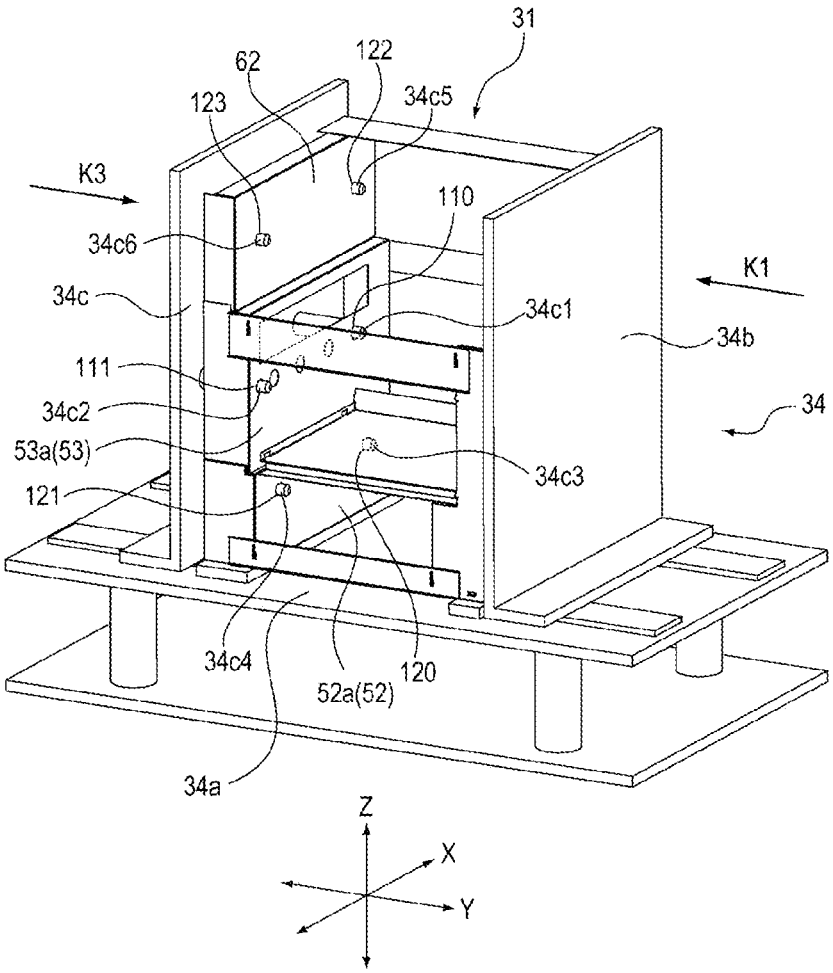
FIG. 27 is a perspective view of the frame and the jig.
Figure 28:
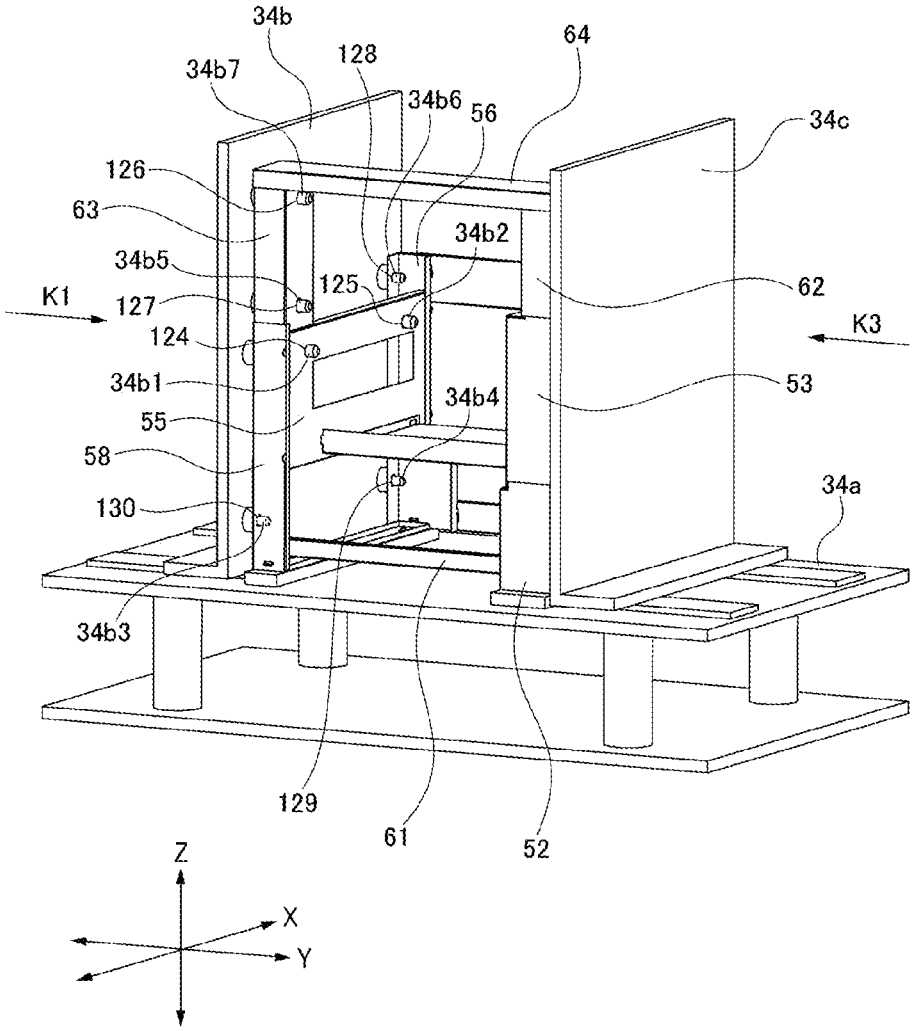
FIG. 28 is a perspective view of the frame and the jig.

Next, as illustrated in FIGS. 27 and 28, the operator slides the front side support portion 34b in an arrow K1 direction and the rear side support portion 34c in an arrow K3 direction. At this time, as the rear side support portion 34c slides in the arrow K3 direction, the positioning pin 34c1 (insertion portion) of the rear side support portion 34c is inserted into the circular round hole 110 (hole portion) formed in the support portion 53a of the rear side plate 53, and is positioned at the time of being fixed to the rear side plate 52 of the rear side plate 53. Further, the positioning pin 34c2 (another insertion portion) of the rear side support portion 34c is inserted into an elongated hole 111 (another hole portion) formed in the support portion 53a of the rear side plate 53 and extending in the arrow X direction, and the rear side plate 53 is restricted from rotating around positioning pin 34c1. The round hole 110 and the elongated hole 111 are through-holes formed in the support portion 53a and penetrating the support portion 53a in the plate thickness direction (arrow Y direction).

Further, the positioning pin 34c3 of the rear side support portion 34c is inserted into the circular round hole 120 formed in the flat surface portion 52a of the rear side plate 52, and the position of the rear side plate 52 when fixed to the rear bottom plate 51 is determined. Further, the positioning pin 34c4 of the rear side support portion 34c is inserted into an elongated hole 121 formed in the flat surface portion 52a of the rear side plate 52 and extending in the arrow X direction, and the rear side plate 52 is restricted from rotating around positioning pin 34c3. The round hole 120 and the elongated hole 121 are through-holes formed in the flat surface portion 52a and penetrating the flat surface portion 52a in the plate thickness direction (arrow Y direction).

Further, the positioning pin 34c5 of the rear side support portion 34c is inserted into the circular round hole 122 formed in the rear side plate 62, and the position of the rear side plate 62 when fixed to the rear side plate 53 is determined. Further, the positioning pin 34c6 of the rear side support portion 34c is inserted into an elongated hole 123 formed in the rear side plate 62 and extending in the arrow X direction, and the rear side plate 62 is restricted from rotating around positioning pin 34c5. The round hole 122 and the elongated hole 123 are through-holes formed in the rear side plate 62 and penetrating in the arrow Y direction.

In addition, regarding the front side plate 55, the left support column 56, and the right support columns 58 and 63, similar to the rear side plates 52, 53, and 62, as the front side support portion 34b slides in the arrow K1 direction, positioning pins 34b1 to 34b7 of the front side support portion 34b are inserted into the circular round holes 124 to 130 formed in the front side plate 55, the left support column 56, and the right support columns 58 and 63. More specifically, the positioning pin 34b4 is inserted into the round hole 129, and the positioning pin 34b3 is inserted into the round hole 130. The positioning pin 34b1 is inserted into the round hole 124, and the positioning pin 34b2 is inserted into the round hole 125. The positioning pin 34b7 is inserted into the round hole 126, the positioning pin 34b5 is inserted into the round hole 127, and the positioning pin 34b6 is inserted into the round hole 128. As a result, the positions of the front side plate 55, the left support column 56, and the right support column 58 and 63 at the time of fixing are determined. At this time, the positioning pins 34*b*1 and 34*b*2 (insertion portions) are inserted into the round holes 124 and 125 (hole portions) formed in the front side plate 55, so that the front side plate 55 is moved upward in the vertical direction, and as will be described later, the vertical position is aligned with the rear side plate 53 that moves upward in the vertical direction.

Next, the front side support portion 34*b* is pressed in the arrow K1 direction and the rear side support portion 34*c* is pressed in the arrow K3 direction by a pressing device (not illustrated). As a result, the metal plates constituting the frame 31 are pressed against each other, such that unnecessary gaps between the metal plates are eliminated. Thereafter, the operator welds and fixes each metal plate constituting the frame 31 by fiber laser welding. When the fixing of the frame 31 is completed, the operator slides the front side support portions 34*b* in the arrow K2 direction, slides the rear side support portions 34*c* in the arrow K4 direction, and detaches the frame 31 from the jig 34. As a result, the frame 31 is completed. Although the present embodiment describes a configuration in which each metal plate constituting the frame 31 is fixed by welding, the present invention is not limited to this, and the metal plates are fixed to each other by other methods such as screw fixing.

<Frame Positioning Process>

As described above, in the assembling step before fixing each metal plate constituting the frame 31, these metal plates are fitted to each other and the position at the time of temporary assembly is determined. On the other hand, in the fixing step, the jig 34 determines the position of each metal plate constituting the frame 31 at the time of fixing. In this way, the positions of the metal plates constituting the frame 31 are different between the temporarily assembled state and the fixed state in which the metal plates constituting the frame 31 are temporarily assembled. Hereinafter, the positioning of each metal plate constituting the frame 31 in the positioning step will be described in detail focusing on the positioning of the rear side plate 53.

Figure 29B:
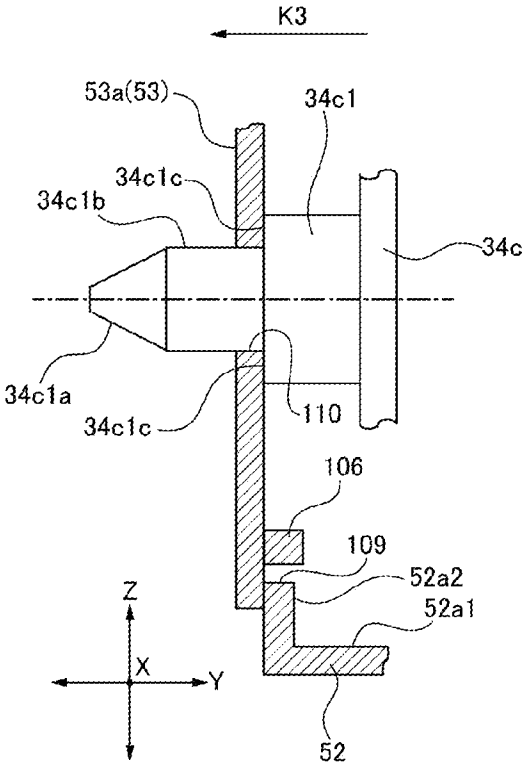
FIGS. 29A and 29B are schematic cross-sectional views illustrating a positional relationship between a positioning pin and the rear side plate.
Figure 29A:
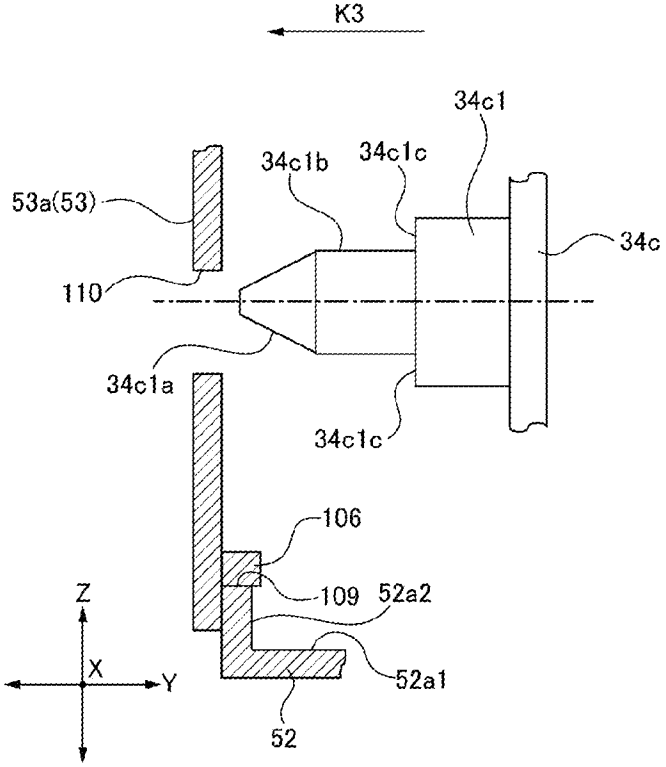

FIGS. 29A and 29B are schematic cross-sectional views illustrating the positional relationship between the positioning pins 34*c*1 and the rear side plates 52 and 53 before and after sliding the rear side support portion 34*c* of the jig 34 in the arrow K3 direction in the positioning step. FIG. 29A illustrates the state before the rear side support portion 34*c* slides (the state before the fixed position is determined), and FIG. 29B illustrates the state after the rear side support portion 34*c* slides (the state after the fixed position is determined).

As illustrated in FIGS. 29A and 29B, the outer peripheral portion of the tip portion of the positioning pin 34*c*1 of the rear side support portion 34*c* is provided with an inclined portion 34*c*1*a* inclined in the vertical direction (arrow Z direction) with respect to the insertion direction (arrow Y direction) of the positioning pin 34*c*1 with respect to the round hole 110 of the rear side plate 53. The inclined portion 34*c*1*a* has a tapered shape in which the diameter decreases from the base end portion to the tip portion of the positioning pin 34*c*1. Further, a flat portion 34*c*1*b* whose surface extends in the arrow Y direction is provided on the base end side of the inclined portion 34*c*1*a* of the positioning pin 34*c*1. Further, the base end side of the flat portion 34*c*1*b* of the positioning pin 34*c*1 is provided with a positioning surface 34*c*1*c* that abuts on the support portion 53*a* of the rear side plate 53 and determines the position of the rear side plate 53 in the arrow Y direction. Note that the other positioning pins 34*c*2 to 34*c*6 of the rear side support portion 34*c* of the jig 34 and the positioning pins 34*b*1 to 34*b*7 of the front side support portion 34*b* also have the same shape as the positioning pins 34*c*1.

In the fixing process, when the rear side support portion 34*c* slides in the arrow K3 direction and the positioning pin 34*c*1 is inserted into the round hole 110 of the rear side plate 53, the upper portion of the inner wall of the round hole 110 and the inclined portion 34*c*1*a* of the positioning pin 34*c*1 are in contact with each other. When the positioning pin 34*c*1 is further inserted as it is, the upper portion of the inner wall of the round hole 110 is pushed up by the inclined portion 34*c*1*a* of the positioning pin 34*c*1, and the entire rear side plate 53 moves upward in the vertical direction with respect to the rear side plate 52. Thereafter, when the positioning pin 34*c*1 is further inserted and the flat portion 34*c*1*b* is inserted into the round hole 110, the flat portion 34*c*1*b* is fitted to the inner wall of the round hole 110, and the position of the rear side plate 53 in the arrow X direction and the arrow Z direction when fixed is determined. Further, when the positioning pin 34*c*1 is further inserted and the positioning surface 34*c*1*c* abuts on the support portion 53*a* of the rear side plate 53, the positioning surface 34*c*1*c* determines the position of the rear side plate 53 in the arrow Y direction. In this way, the position of the rear side plate 53 is determined by the positioning pin 34*c*1 in the arrow X direction, the arrow Y direction, and the arrow Z direction. Similar to the rear side plate 53, the other metal plate constituting the frame 31 is also determined by the positioning pins 34*b*1 to 34*b*7 of the front side support portion 34*b* of the jig 34 or the positioning pins 34*c*1 to 34*c*6 of the rear side support portion 34*c* when fixed.

As described above, in the present embodiment, the frame 31 is manufactured by not fixing the metal plate constituting the frame 31 as it is in the assembled state, but the frame 31 is manufactured by positioning the frame 31 with a jig 34 and then fixing the frame 31 by welding or the like. As a result, the position accuracy of each metal plate constituting the frame 31 after fixing is less likely to be affected by the tolerance when forming each metal plate. Even when the metal plate is positioned by the jig 34, although it is affected by the tolerance of the jig 34, the tolerance of the positioning jig 34 is generally smaller than the tolerance when processing the metal plate. Therefore, according to the configuration of the present embodiment, the deterioration of the position accuracy after fixing of each metal plate constituting the frame 31 is suppressed, and deterioration of the position accuracy between the members supported by the frame 31 is suppressed, thereby making it possible to suppress adverse effects on image quality.

Figure 30A:
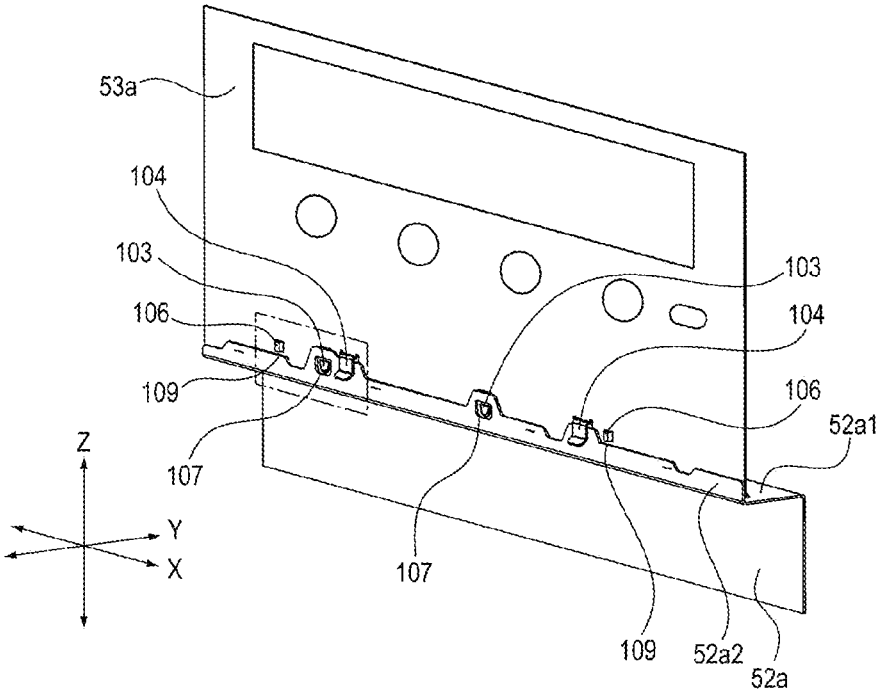
FIGS. 30A and 30B are perspective views of a flat portion of the rear side plate and a support portion of the rear side plate when fixed.
Figure 30B:
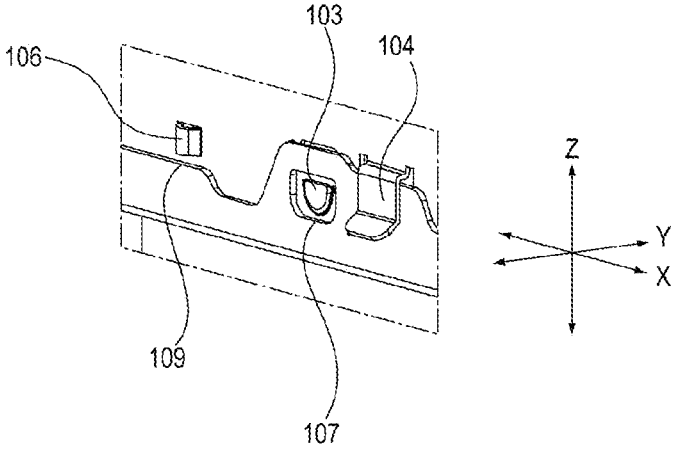

Further, as illustrated in FIGS. 30A and 30B, when the positioning pin 34*c*1 is inserted into the round hole 110 of the rear side plate 53 and the rear side plate 53 moves upward in the vertical direction, the stopper portion 106 of the rear side plate 53 is separated from the abutting portion 109 of the rear side plate 52. As a result, the stopper portion 106 of the rear side plate 53 and the rear side plate 52 are not in contact with each other during welding in the fixing process. In FIGS. 30A and 30B, the rear side support portion 34*c* is omitted. Further, in the state where the vertical position of the rear side plate 53 with respect to the rear side plate 52 is determined in the fixing process, the upper end portion of the projection portion 103 of the rear side plate 53 becomes non-contact with the inner wall of the through-hole 107 of the rear side plate 52. This is because when the rear side plate 53 moves upward in the vertical direction in the positioning process, the projection portion 103 moves inside the gap between the inner wall of the through-hole 107 and the upper end portion of the projection portion 103, and the position of the rear side plate 53 in the vertical direction before they come into contact with each other is determined and thus the rear side plate 53 is stopped from moving upward.

In this way, since the stopper portion 106 is in contact with the abutting portion 109 in the positioning process, as the rear side support portion 34*c* slides in the fixing process, the positioning pins 34*c*1 and 34*c*2 can be inserted into the round hole 110 and the elongated hole 111, respectively, to maintain the position accuracy. Further, in the fixing process, since the stopper portion 106 and the abutting portion 109 are separated from each other, it is possible to prevent the rear side plate 52 and the rear side plate 53 from being fixed under the influence of the dimensional tolerance of the metal plate and the processing tolerance.

Further, the projection portion 103 functions as a retaining member for suppressing the rear side plate 53 from coming off vertically upward with respect to the rear side plate 52 in the assembly process of the frame 31, but is configured not to hinder the positioning of the fixed positions of the rear side plate 53 and the rear side plate 52 in the fixing process.

Note that in this embodiment, the stopper portion 106 is configured to restrict the vertical downward position of the rear side plate 53 with respect to the rear side plate 52. However, when the positioning pins 34*c*1 and 34*c*2 can maintain the position accuracy that can be inserted into the round hole 110 and the elongated hole 111, respectively, as the rear side support portion 34*c* slides, the positioning pins 34*c*1 and 34*c*2 may be configured to restrict the vertical downward position of the rear side plate 53 with respect to the rear side plate 52 by the step-bent portion 104 without being provided with the stopper portion 106.

Figure 31:
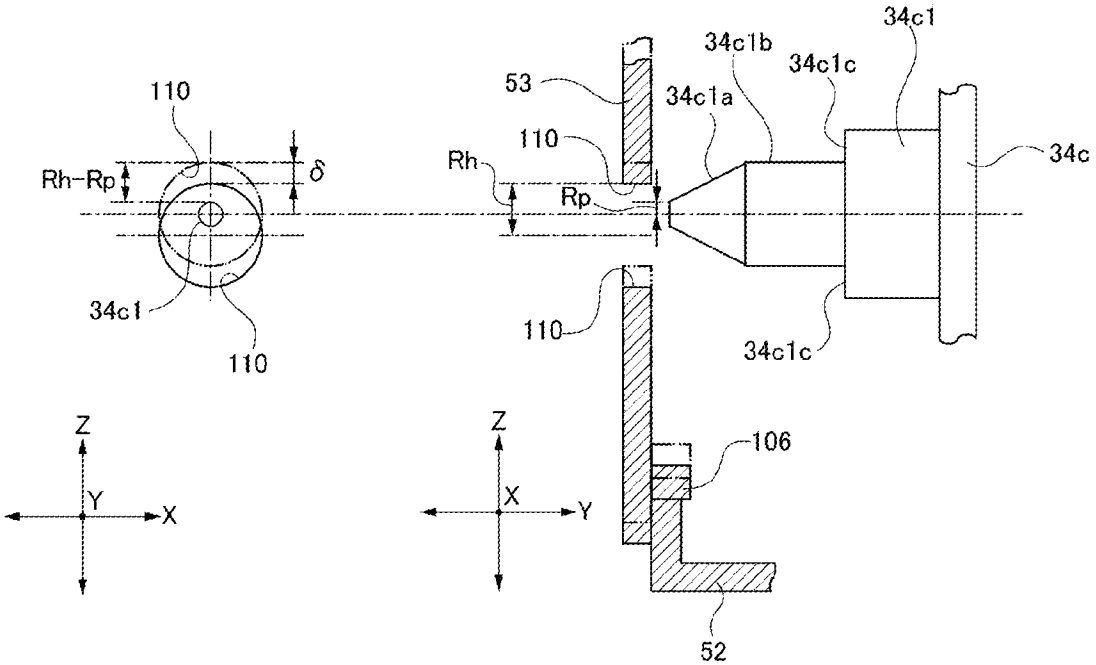
FIG. 31 is a schematic cross-sectional view of a positioning pin and a round hole.

Note that in the step before inserting the positioning pin 34*c*1, the center position of the round hole 110 of the rear side plate 53 and the center position of the positioning pin 34*c*1 of the rear side support portion 34*c* do not match. Therefore, in order to insert the positioning pin 34*c*1 into the round hole 110 by the sliding operation of the rear side support portion 34*c*, it is necessary to specify the radius of the tip portion of the positioning pin 34*c*1, the radius of the round hole 110, and the position of the stopper portion 106. As illustrated in FIG. 31, the radius of the round hole 110 is defined as Rh, the radius of the tip portion of the positioning pin 34*c*1 is defined as Rp, and the amount of movement of the rear side plate 53 upward in the vertical direction when the positioning pin 34*c*1 is inserted into the round hole 110 is defined as δ. At this time, by setting the values of the radii Rh and Rp, and the movement amount δ so as to satisfy the following Equation 1, the positioning pin 34*c*1 can be inserted into the round hole 110 by the sliding operation of the rear side support portion 34*c*. The movement amount δ can be set by changing the position of the stopper portion 106 in the vertical direction.

$$Rh-Rp>\delta \quad \text{(Equation 1)}$$

From the above Equation 1, it can be seen that the larger the radius Rh of the round hole 110, the larger the movement amount δ. On the other hand, in order to maintain the strength of the rear side plate 53 and to secure the mounting position of each member of the image forming apparatus A, it is preferable that the radius Rh of the round hole 110 is small. Therefore, it is necessary to set each dimension of the above Equation 1 in consideration of the balance therebetween.

Figure 32:
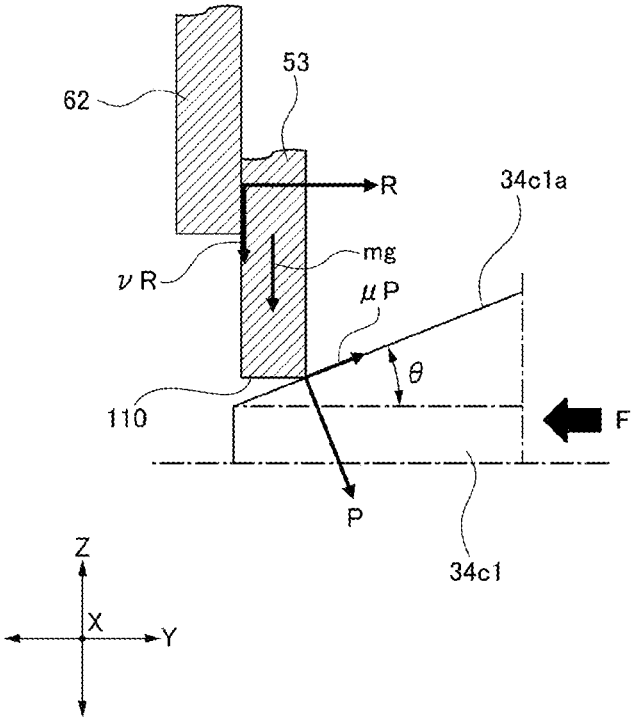
FIG. 32 is a schematic cross-sectional view of the positioning pin and the rear side plate.

Further, as illustrated in FIG. 32, the inclination angle of the inclined portion 34*c*1*a* of the positioning pin 34*c*1 in the vertical direction with respect to the arrow Y direction is defined as θ, and the own weight of the rear side plate 53 is defined as mg. Further, a force (force for pushing the positioning pin 34*c*1) applied when the positioning pin 34*c*1 is inserted into the round hole 110 is defined as F, a force acting on the positioning pin 34*c*1 from the rear side plate 53 is defined as P, and a reaction force acting from the rear side plate 62 to the rear side plate 53 is defined as R. A coefficient of friction between the positioning pin 34*c*1 and the rear side plate 53 is defined as μ, a coefficient of friction between the rear side plate 52 and the rear side plate 53 is defined as ω, and a coefficient of friction between the rear side plate 53 and the rear side plate 62 is defined as v. At this time, the positioning pin 34*c*1 can be inserted all the way into the round hole 110 by satisfying the following Equation 2.

$$F > \frac{\tan\theta + \mu}{1 - \mu\omega - \mu v - (\mu + \mu)\tan\theta} mg \quad \text{(Equation 2)}$$

In the above Equation 2, the larger the force F, the easier it is for the rear side plate 53 to lift, but if the force F is too large, the rear side plate 53 may be plastically deformed. On the other hand, when the angle θ is reduced in order to reduce the force F, it is necessary to increase the length of the positioning pin 34*c*1 in the arrow Y direction in order to lift the rear side plate 53 to a predetermined height. When the positioning pin 34*c*1 becomes long, the slide distance of the rear side support portion 34*c* required for inserting the positioning pin 34*c*1 into the round hole 110 becomes long, which leads to an increase in the size of the jig 34. Therefore, it is necessary to set each dimension of the above Equation 2 in consideration of the balance between the suppression of the plastic deformation of the rear side plate 53 and the suppression of the size of the jig 34 from increasing Note that as described above, by inserting the positioning pin 34*c*1 into the round hole 110, the stopper portion 106 of the rear side plate 53 is separated from the rear side plate 52. Here, when there is almost no friction (rubbing) between the rear side plate 52 and the rear side plate 53 due to the shape and insertion angle of the positioning pin 34*c*1, and this friction does not need to be taken into consideration, "−μω" may be eliminated from the above Equation 2.

Note that in this embodiment, the lengths of the positioning pins 34*c*1 to 34*c*6 in the arrow Y direction are the same. Therefore, the rear side plates 52, 53, and 62 are positioned at the same time by sliding the rear side support portion 34*c* in the arrow K3 direction. However, the positions of the rear side plates 52, 53, and 62 may be sequentially positioned by changing the lengths of the positioning pins 34*c*1 to 34*c*6 in the arrow Y direction. For example, the lengths of the positioning pins 34*c*5 and 34*c*6 in the arrow Y direction are made shorter than the lengths of the positioning pins 34*c*1 and 34*c*2 in the arrow Y direction, and the positioning pins 34*c*5 and 34*c*6 may be configured to determine the position of the rear side plate 62 after determining the position of the rear side plate 53 at the time of fixing. In this way, the positioning of the rear side plates 52, 53, 62 at the time of fixing is sequentially performed, so that the positioning accuracy of the rear side plates 52, 53, 62 at the time of fixing can be further improved.

Further, in the present embodiment, the configuration in which the hole into which the positioning pin 34*c*1 is inserted in the rear side plate 53 is a circular round hole 110 and the positioning pin 34*c*1 has a cylindrical shape has been described, but the present invention is not limited thereto. That is, even when the hole into which the positioning pin 34*a*1 is inserted in the rear side plate 53 is a square hole, the positioning pin 34*c*1 is a prism shape with a gradient at the tip, and each parameter is set so as to satisfy the above Equation 2, the same effect as described above can be obtained.

Further, in the present embodiment, the configuration in which the rear side support portion 34*c* can slide and move only in the arrow Y direction has been described, but the present invention is not limited thereto. That is, when the movement amount δ of the rear side plate 53 is large, the rear side support portion 34*c* may be configured to be movable in the vertical direction (arrow Z direction). However, in order to reduce the size and simplification of the jig 34, it is preferable to have a configuration with few moving parts. Therefore, as in the present embodiment, it is preferable that the rear side support portion 34*c* operates only in the Y direction of the arrow so that each metal plate constituting the frame 31 can be positioned.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-148983, filed Sep. 4, 2020, which is hereby incorporated by reference herein in its entirety.

What is claimed is:

1. A method of manufacturing a metal frame of an image forming apparatus including a first support that includes a first metal plate and a second metal plate disposed above the first metal plate in a vertical direction and configured to support one end of an image forming unit, a second support disposed at intervals with respect to the first support and configured to support another end of the image forming unit with the first support, and a connecting member that connects the first support and the second support, the method comprising the steps of:

assembling the first support, the second support, and the connecting member using a first jig including a base portion, in the assembling, in the first support, a restricting portion formed on one of the first metal plate and the second metal plate abutting on the other metal plate so as to restrict movement of the second metal plate downward in the vertical direction with respect to the first metal plate;

positioning a position where the first support, the second support, and the connecting portion are fixed using a second jig including an insertion portion, in the positioning, in the first support, the insertion portion being inserted into a hole portion formed in the second metal plate so that the second metal plate moves upward in the vertical direction with respect to the first metal plate, and the restricting portion abutted in the assembling and the other metal plate being separated from each other; and fixing the first support and the connecting member in a state in which the position is determined in the positioning, and fixing the second support and the connecting member in the state where the position is determined in the positioning, in the fixing, the first metal plate and the second metal plate being fixed.

2. The method of manufacturing a metal frame of an image forming apparatus according to claim 1, wherein an outer peripheral portion of the insertion portion is provided with an inclined portion inclined such that a diameter becomes larger from a tip of the insertion portion toward a base end side of the insertion portion in an insertion direction of the insertion portion into the hole portion.

3. The method of manufacturing a metal frame of an image forming apparatus according to claim 2, wherein the first support further includes a third metal plate that is disposed above the second metal plate in the vertical direction, and comes into contact with the second metal plate, and wherein an inclination angle of the insertion portion with respect to the insertion direction is θ, a force in the insertion direction applied in a case the insertion portion is inserted into the hole portion is F, an own weight of the second metal plate is mg, a coefficient of friction between the insertion portion and the second metal plate is μ, a coefficient of friction between the first metal plate and the second metal plate is ω, and a coefficient of friction between the second metal plate and the third metal plate is ν, $$F > \frac{\tan\theta + \mu}{1 - \mu\omega - \mu\nu - (\mu + \mu)\tan\theta} mg$$

is satisfied.

4. The method of manufacturing a metal frame of an image forming apparatus according to claim 1, wherein the restricting portion is a protrusion portion that is provided on the second metal plate, formed by press working, and protrudes in a horizontal direction, and abuts on an upper edge of the first metal plate in the vertical direction.

5. The method of manufacturing a metal frame of an image forming apparatus according to claim 1, wherein the second metal plate includes another restricting portion that engages with an engaging hole formed in the first metal plate and abuts on an inner wall of the engaging hole to restrict the movement of the second metal plate upward in the vertical direction with respect to the first metal plate, wherein the position of the second metal plate in the vertical direction with respect to the first metal plate is determined in the assembling, the another restricting portion engages with the engaging hole in a state in which a gap is formed between the inner wall of the engaging hole and an upper end portion of the another restricting portion, and wherein the second metal plate moves upward in the vertical direction in the positioning, an amount of movement of the another restricting portion is smaller than the gap, so that the another restricting portion does not come into contact with the inner wall of the engaging hole.

6. The method of manufacturing a metal frame of an image forming apparatus according to claim 1, wherein in the second metal plate, another hole portion different from the hole portion is formed in the surface on which the hole portion is formed, the second jig includes another insertion portion to be inserted into the another hole portion, and in the positioning, the another insertion portion is inserted into the another hole portion to restrict the second metal plate rotating about the insertion portion.

7. The method of manufacturing a metal frame of an image forming apparatus according to claim 1, wherein the second support is provided with a hole portion, and in the positioning, an insertion portion of a third jig is inserted into the hole portion of the second support, so that the second support moves upward in the vertical direction and the positions of the first support and the second support in the vertical direction are aligned.

8. The method of manufacturing a metal frame of an image forming apparatus according to claim 7, wherein in the positioning, an insertion direction in which the insertion portion of the second jig is inserted into the hole portion of the first support is a direction opposite to an insertion direction in which the insertion portion of the third jig is inserted into the hole portion of the second support.

9. The method of manufacturing a metal frame of an image forming apparatus according to claim 8, wherein the first support includes a third metal plate in which a hole portion into which the insertion portion of the third jig is inserted is formed, and a support column that supports the third metal plate, the image forming unit includes a photosensitive drum, and the second metal plate fixed in the fixing supports the photosensitive drum together with the third metal plate.

10. The method of manufacturing a metal frame of an image forming apparatus according to claim 1, wherein the assembling includes:

erecting the first support on the base portion;

supporting the connecting member on the first support and the support portion by placing the connecting member on a support portion erected from the base portion of the first jig and engaging the first support with the connecting member; and engaging the connecting member and the second support on the support portion.

* * * * *